US011805844B2

(12) United States Patent
Holmes et al.

(10) Patent No.: US 11,805,844 B2
(45) Date of Patent: Nov. 7, 2023

(54) ARTICLE OF FOOTWEAR WITH HEEL CUSHIONING UNIT AND SIDE WITH STEPPED RIDGES

(71) Applicant: NIKE, Inc., Beaverton, OR (US)

(72) Inventors: Edmund Holmes, Portland, OR (US); Justin D. Humphreys, Portland, OR (US); Kuang-Nan Liao, Portland, OR (US); Stuart Pollock, Milwaukie, OR (US); Marlon Rainville, Portland, OR (US); Jay T. Worobets, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 232 days.

(21) Appl. No.: 17/219,947

(22) Filed: Apr. 1, 2021

(65) Prior Publication Data

US 2021/0368919 A1 Dec. 2, 2021

Related U.S. Application Data

(60) Provisional application No. 63/030,955, filed on May 28, 2020.

(51) Int. Cl.

| | |
|---|---|
| ***A43B 13/18*** | (2006.01) |
| ***A43B 13/12*** | (2006.01) |
| ***A43B 7/14*** | (2022.01) |

(52) U.S. Cl.

CPC ..... *A43B 13/186* (2013.01); *A43B 7/1495* (2013.01); *A43B 13/125* (2013.01); *A43B 13/181* (2013.01)

(58) Field of Classification Search

CPC ..... A43B 13/181; A43B 13/186; A43B 13/12; A43B 13/125; A43B 13/122;

(Continued)

(56) References Cited

U.S. PATENT DOCUMENTS 4,484,397 A * 11/1984 Curley, Jr. ..... A43B 23/17 36/132

4,624,061 A 11/1986 Wezel et al.

(Continued)

FOREIGN PATENT DOCUMENTS

AU 2006201182 A1 12/2006
EP 0096819 A1 12/1983

(Continued)

*Primary Examiner* — Khoa D Huynh
*Assistant Examiner* — Haley A Smith
(74) *Attorney, Agent, or Firm* — Quinn IP Law

(57) ABSTRACT

An article of footwear has a sole structure including a heel cushioning unit. The heel cushioning unit has a top portion, a bottom portion, a body portion connecting the top portion to the bottom portion, medial support fins in a medial side recess at a medial side of the heel cushioning unit and lateral support fins in a lateral side recess at a lateral side of the heel cushioning unit. Both the medial support fins and the lateral support fins extend transversely outward from the body portion and extend from the top portion to the bottom portion. The heel cushioning unit defines a through hole extending from the medial side to the lateral side and disposed rearward of the medial support fins and the lateral support fins. The article of footwear has an outsole with arch portions defining stepped ridges extending lengthwise in a fore-aft direction of the sole structure.

19 Claims, 16 Drawing Sheets

(58) Field of Classification Search
CPC ..... A43B 13/127; A43B 13/185; A43B 5/001; A43B 7/144; A43B 7/1495; A43C 1/00; A43C 1/04; A43C 11/00
USPC ..... D2/961
See application file for complete search history.

(56) References Cited

U.S. PATENT DOCUMENTS 5,692,319 A * 12/1997 Parker ..... A43C 1/00 36/114
6,789,331 B1 9/2004 Ellis, III
6,862,821 B2 * 3/2005 Parisotto ..... A43B 13/026 36/88
7,334,349 B2 * 2/2008 Sokolowski ..... A43B 13/187 36/28
7,793,432 B2 * 9/2010 Chan ..... A43B 21/32 36/27
8,336,230 B2 * 12/2012 Crowley ..... A43B 21/24 36/105
8,468,720 B2 6/2013 Sokolowski et al.
9,038,288 B2 * 5/2015 Droege ..... A43B 5/025 36/133
9,259,049 B2 2/2016 Adami et al.
9,693,604 B2 7/2017 Cin et al.
9,867,426 B2 1/2018 Conant et al.
10,238,173 B2 * 3/2019 Ngene ..... A43B 13/125
2010/0281711 A1 * 11/2010 Vestuti ..... A43B 13/181 36/35 R
2011/0289799 A1 * 12/2011 Keating ..... A43B 13/181 36/103
2014/0215857 A1 * 8/2014 Curl ..... A43C 15/161 36/134
2015/0216258 A1 * 8/2015 Ueda ..... A43B 23/0235 36/87
2015/0342300 A1 * 12/2015 Cin ..... A43B 13/127 36/103
2017/0258179 A1 * 9/2017 Conant ..... A43B 7/14

FOREIGN PATENT DOCUMENTS

EP 3061363 A1 8/2016
WO WO-2013014433 A1 * 1/2013 ..... A43B 13/24
WO 2014178739 A2 11/2014

* cited by examiner

ARTICLE OF FOOTWEAR WITH HEEL CUSHIONING UNIT AND SIDE WITH STEPPED RIDGES

CROSS-REFERENCE TO RELATED APPLICATIONS

This application claims the benefit of priority to U.S. Provisional Application No. 63/030,955, filed May 28, 2020 which is incorporated by reference in its entirety.

TECHNICAL FIELD

The present disclosure generally relates to an article of footwear that may include a heel cushioning unit with support fins and/or a side with stepped ridges.

BACKGROUND

Footwear typically includes a sole structure configured to be located under a wearer's foot to space the foot away from the ground or floor surface. Athletic footwear in particular sometimes utilizes polyurethane foam, rubber, and/or other resilient materials in the sole structure to provide cushioning.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
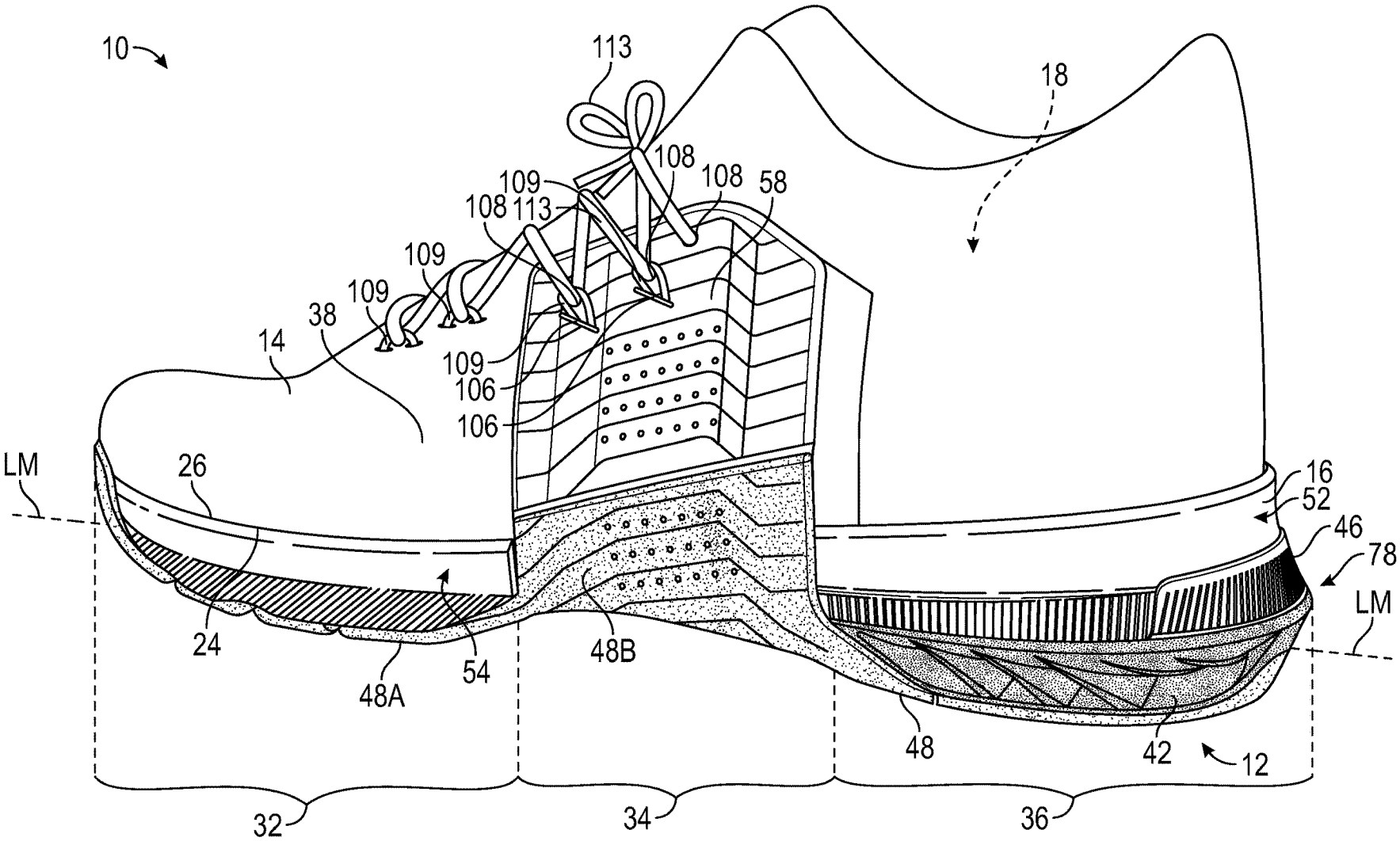
FIG. 1 is a perspective view showing the medial side of an article of footwear.

The present disclosure generally relates to an article of footwear that may have features beneficial for certain activities. For example, the article of footwear may include a sole structure that provides greater support at a medial side of the sole structure for extra loading that may occur during activities such as weightlifting, that includes features for easing inverted wall pushups, and that includes features for efficiency in rope climbing.

More specifically, an article of footwear may comprise a sole structure including a heel cushioning unit. The heel cushioning unit may have a top portion, a bottom portion, a body portion connecting the top portion to the bottom portion, medial support fins in a medial side recess defined by the heel cushioning unit at a medial side of the heel cushioning unit and lateral support fins in a lateral side recess defined by the heel cushioning unit at a lateral side of the heel cushioning unit. Both the medial support fins and the lateral support fins may extend transversely outward from the body portion and from the top portion to the bottom portion. The heel cushioning unit may define a through hole extending from the medial side to the lateral side and disposed rearward of the medial support fins and the lateral support fins.

Because the medial and lateral support fins extend outward from the body portion, they provide greater resistance to compression (e.g., greater stiffness) than if they were separated from the body portion. In contrast, the transversely-extending through hole increases the compressibility of the heel cushioning unit in the vertical direction (e.g., under compressive loading of the top portion toward the bottom portion). The orientation and number of the support fins are selected to tune the compressibility of the heel cushioning unit.

Additionally, a rear wall of the heel cushioning unit may enclose the through hole rearward of the through hole and may extend from the top portion to the bottom portion of the heel cushioning unit. The rear wall may contribute to the heel cushioning unit resiliently returning to an initial state when compressive loading is reduced. Other features such as a beveled upper edge of the heel cushioning unit and a heel guard help to reduce friction and ease sliding against a wall during inverted wall pushups.

In another aspect, an upper may be coupled to the sole structure, and the sole structure may further comprise an outsole underlying a bottom surface of the heel cushioning unit. The outsole may have an arch portion wrapping upward along and secured to a side surface of the upper above a biteline between the sole structure and the upper. A side shield may extend upward from the arch portion along the side surface of the upper. An exterior of the side shield and/or an exterior of the arch portion may include stepped ridges extending lengthwise in a fore-aft direction of the article of footwear. Each stepped ridge may be relatively thicker at a lower extent of the stepped ridge than at an upper extent of the stepped ridge such that the stepped ridge angles outward from the upper extent to the lower extent. This configuration enables the stepped ridges to provide grip in one direction of movement while promoting ease of sliding in the opposite direction of movement.

Additionally, each stepped ridge may include a series of linear segments along its length. The linear segments may include a center linear segment, a front linear segment extending forward and downward from the center linear segment at an obtuse angle, and a rear linear segment extending rearward and downward from the center linear segment at an obtuse angle. This configuration of the linear segments helps to increase friction against an object held against the stepped ridges, such as a rope during rope climbing. The angles between the center linear segment and the front and rear linear segments enable the segments to act as a wedge against movement of the arch portion and/or side shield relative to the rope.

Still further, the side shield may define an aperture, and a tensioning cable may extend through the aperture from an inner side of the side shield to an outer side of the side shield. A lace or other component of a tensioning system may engage the tensioning cable to tighten the side shield against the upper and toward the side of the foot. Conforming the side shield to the shape of the foot via the tensioning cable in this manner may increase the ability of the wearer to sense the position of an object against the side shield such as during rope climbing.

The above features and advantages and other features and advantages of the present teachings are readily apparent from the following detailed description of the modes for carrying out the present teachings when taken in connection with the accompanying drawings.

Figure 19:
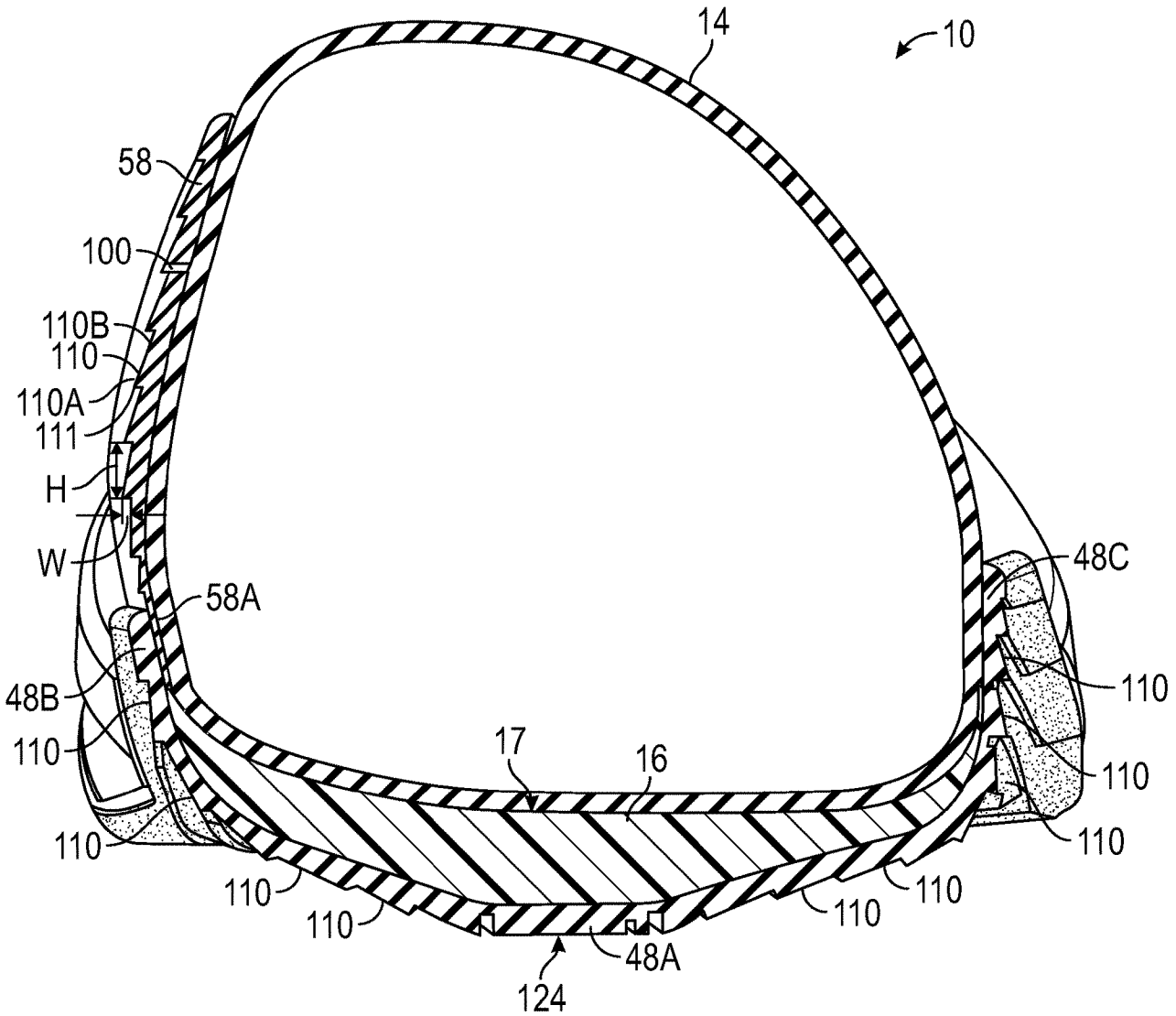
FIG. 19 is a cross-sectional view of the article of footwear taken at lines 19-19 in FIG. 18.

Referring to the drawings, wherein like reference numbers refer to like components throughout the views, FIG. 1 shows an article of footwear 10 that includes a sole structure 12 and an upper 14 secured to the sole structure 12. The sole structure 12 includes a midsole layer 16 which may be, for example, a resilient foam. The upper 14 is secured to a top surface 17 of the midsole layer 16, as best shown in FIG. 19. For example, the upper 14 may be adhered to the top surface 17. A biteline 24 shown in FIG. 1 denotes the junction or intersection of the midsole layer 16 and the upper 14, and is coincident with an upper edge 26 of the midsole layer 16.

The upper 14 forms a foot-receiving cavity 18 configured to receive a foot. The article of footwear 10 may be referred to as footwear 10, and as illustrated herein is depicted as athletic footwear specifically configured for activities such as weightlifting, rope climbing, running, and inverted wall pushups, or for various other activities that may be undertaken during crossfit training or competition, or during other athletic endeavors. Although the article of footwear 10, including the sole structure 12, may be athletic footwear, it may instead be worn and used as a leisure shoe, a dress shoe, a work shoe, a sandal, a slipper, a boot, or as footwear in any other category of footwear.

As indicated in FIG. 1, the article of footwear 10 may be divided into a forefoot region 32, a midfoot region 34, and a heel region 36, which are also the forefoot region, the midfoot region, and the heel region, respectively, of the sole structure 12 and the upper 14. The forefoot region 32 generally includes portions of the article of footwear 10 corresponding with the toes and the metatarsophalangeal joints (which may be referred to as MPT or MPJ joints) connecting the metatarsal bones of the foot and the proximal phalanges of the toes. The midfoot region 34 generally includes portions of the article of footwear 10 corresponding with the arch area and instep of the foot, and the heel region 36 generally corresponds with rear portions of the foot, including the calcaneus bone. The forefoot region 32, the midfoot region 34, and the heel region 36 are not intended to demarcate precise areas of the article of footwear 10, but are instead intended to represent general areas of the article of footwear 10 to aid in the following discussion.

Figure 2:
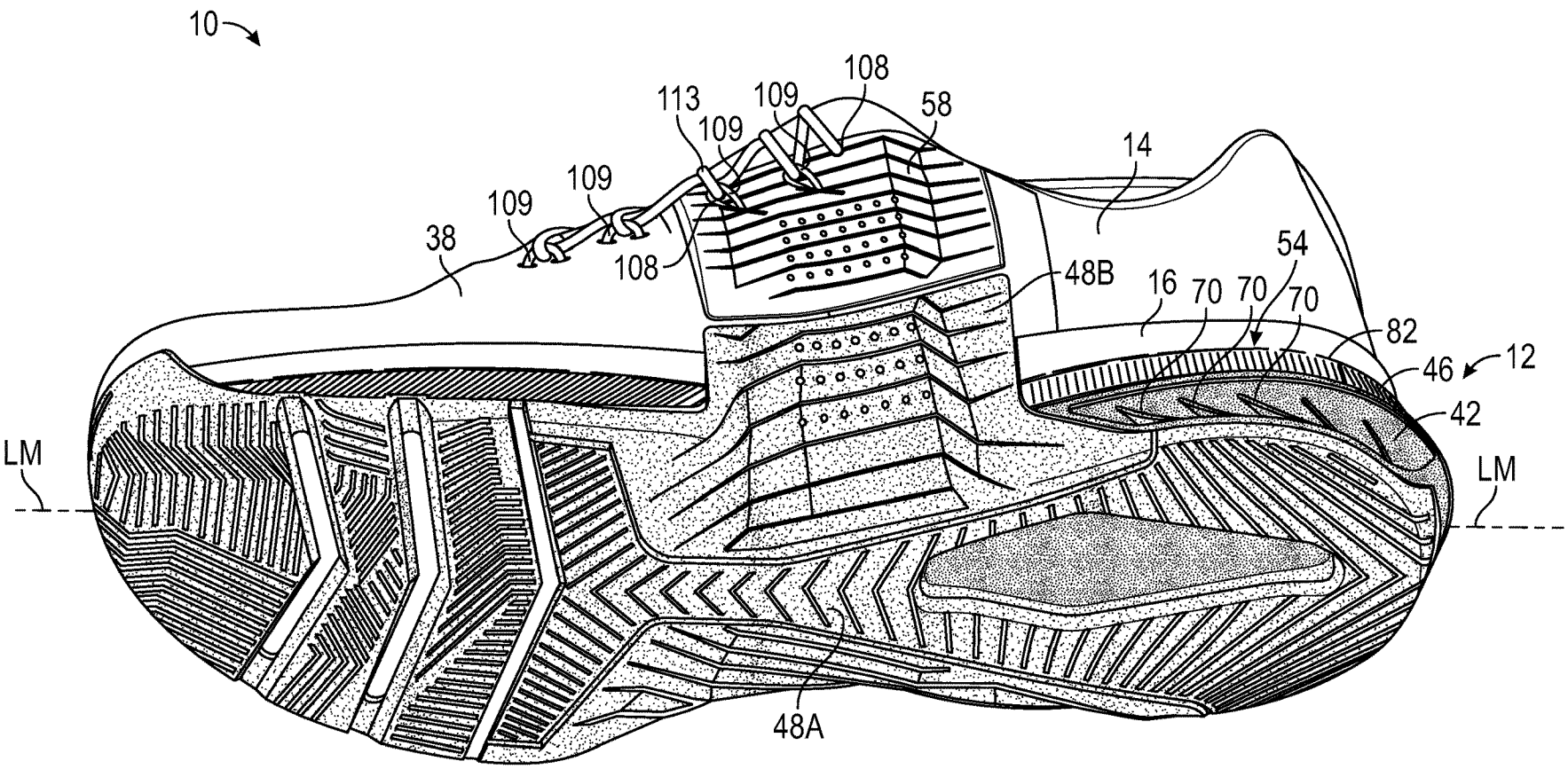
FIG. 2 is another perspective view showing the bottom and the medial side of the article of footwear.
Figure 3:
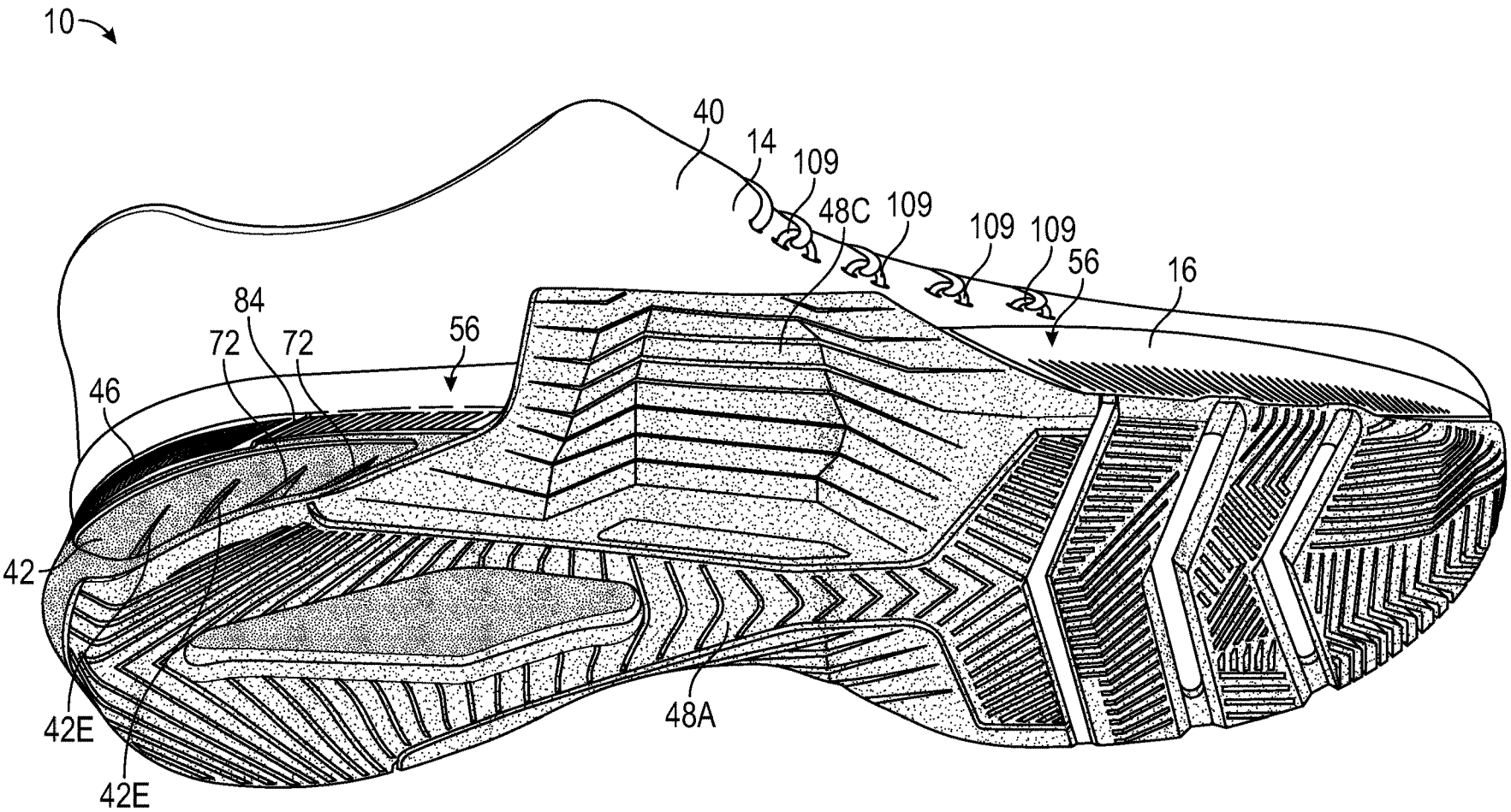
FIG. 3 is another perspective view showing the bottom and the lateral side of the article of footwear.

The article of footwear 10 has a medial side 38 (shown in FIG. 1) and a lateral side 40 (shown in FIG. 3). The medial side 38 and the lateral side 40 extend through each of the forefoot region 32, the midfoot region 34, and the heel region 36, and correspond with opposite sides of the article of footwear 10, each falling on an opposite side of a longitudinal midline LM of the article of footwear 10, indicated in FIG. 2. The medial side 38 is thus considered opposite to the lateral side 40.

The upper 14 may be a variety of materials, such as leather, textiles, polymers, cotton, foam, composites, etc. For example, the upper 14 may be a polymeric material capable of providing elasticity, and may be of a braided construction, a knitted (e.g., warp-knitted) construction, or a woven construction. A lower extent of the upper 14 is secured to a periphery of the sole structure 12 as shown in FIG. 1. The top surface 17 of the midsole layer 16 (shown in FIGS. 14 and 19) may be covered by a strobel (not shown) secured to the lower extent of the upper 14. Alternatively, the upper 14 may be a 360-degree sock-like or bootie-like upper that extends under the foot and over the top surface 17. An insole (not shown) may rest in the foot-receiving cavity 18 on the top surface 17.

The midsole layer 16 may be at least partially a polyurethane foam, or a polyurethane ethylene-vinyl acetate (EVA) foam and may include heat-expanded and molded EVA foam pellets. The midsole layer 16 may generally include phylon (ethylene vinyl acetate or "EVA") and/or polyurethane ("PU") base resins. For example, in one embodiment, the midsole layer 16 may be a compression molded phylon. If EVA is used, it may have a vinyl acetate (VA) level between approximately 9% and approximately 40%. Suitable EVA resins include Elvax®, provided by E. I. du Pont de Nemours and Company, and Engage™, provided by the Dow Chemical Company, for example. In certain embodiments, the EVA may be formed of a combination of high melt index and low melt index material. For example, the EVA may have a melt index of from about 1 to about 50. The EVA resin may be compounded to include various components including a blowing agent and a curing/crosslinking agent. The blowing agent may have a percent weight between approximately 10% and approximately 20%. The blowing agent may be thermally decomposable and may be selected from ordinary organic and inorganic chemical blowing agents. The nature of the blowing agent is not particularly limited as long as it decomposes under the temperature conditions used in incorporating the foam into the virgin resin. Suitable blowing agents include azodicarboamide, for example. In certain embodiments, a peroxide-based curing agent, such as dicumyl peroxide may be used. The amount of curing agent may be between approximately 0.6% and approximately 1.5%. The EVA may also include homogenizing agents, process aids, and waxes. For example, a mixture of light aliphatic hydrocarbons such as Struktol® 60NS, available from Schill+Seilacher "Struktol" GmbH, may be included to permit other materials or scrap EVA to be more easily incorporated into the resin. The EVA may also include other constituents such as a release agent (e.g., stearic acid), activators (e.g., zinc oxide), fillers (e.g., magnesium carbonate), pigments, and clays. In embodiments that incorporate multiple materials, each material may be formed from a material that is compatible and readily bonds with the other material. For example, the materials may each be formed from an EVA resin with suitable blowing agents, crosslinking agents, and other ancillary components, pigments, fillers, and the like. Other suitable materials will become readily apparent to those skilled in the art, given the benefit of this disclosure.

In addition to the midsole layer 16, the sole structure 12 includes a heel cushioning unit 42, a heel guard 46, an outsole 48, and a side shield 58. The heel cushioning unit 42 underlies the midsole layer 16 in the heel region 36, and the heel guard 46 extends along a rear surface 52 of the midsole layer 16. The outsole 48 underlies a bottom surface 53 (FIG. 11) of the midsole layer 16 and has a bottom portion 48A (FIG. 2), a medial arch portion 48B (FIG. 1) and a lateral arch portion 48C (FIG. 3). The medial arch portion 48B extends upward along a medial side surface 54 of the midsole layer 16 in the midfoot region 34 and along the medial side 38 of the upper 14. The medial arch portion 48B is secured to the medial side 38 above the biteline 24. The sole structure 12 also includes a side shield 58 extending from the medial arch portion 48B further up the medial side 38 of the upper 14 and secured to the medial side 38 of the upper 14. The lateral arch portion 48C extends upward along the lateral side surface 56 of the midsole layer 16 in the midfoot region 34. The lateral arch portion 48C is secured to the lateral side 40 of the upper 14 above the biteline 24. Features of each of these components are discussed in greater detail herein.

Figure 5:
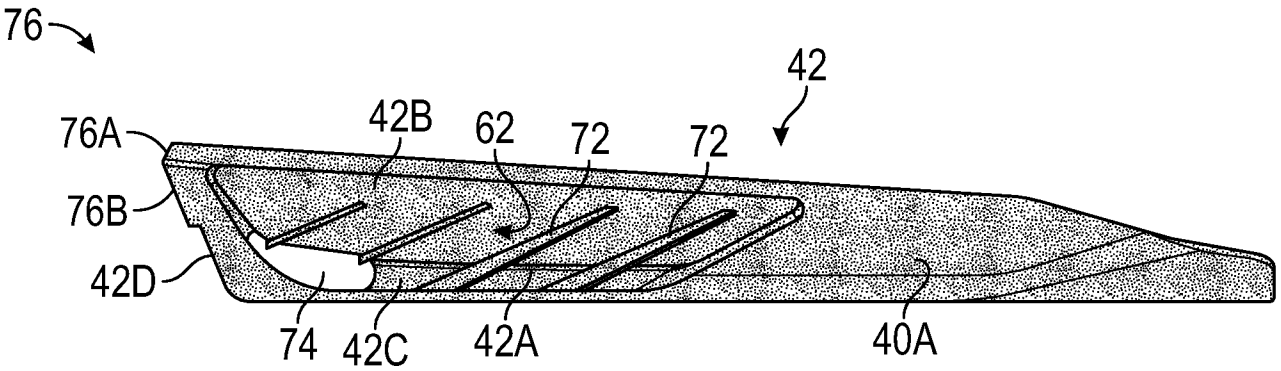
FIG. 5 is a lateral side view of the heel cushioning unit.
Figure 6:
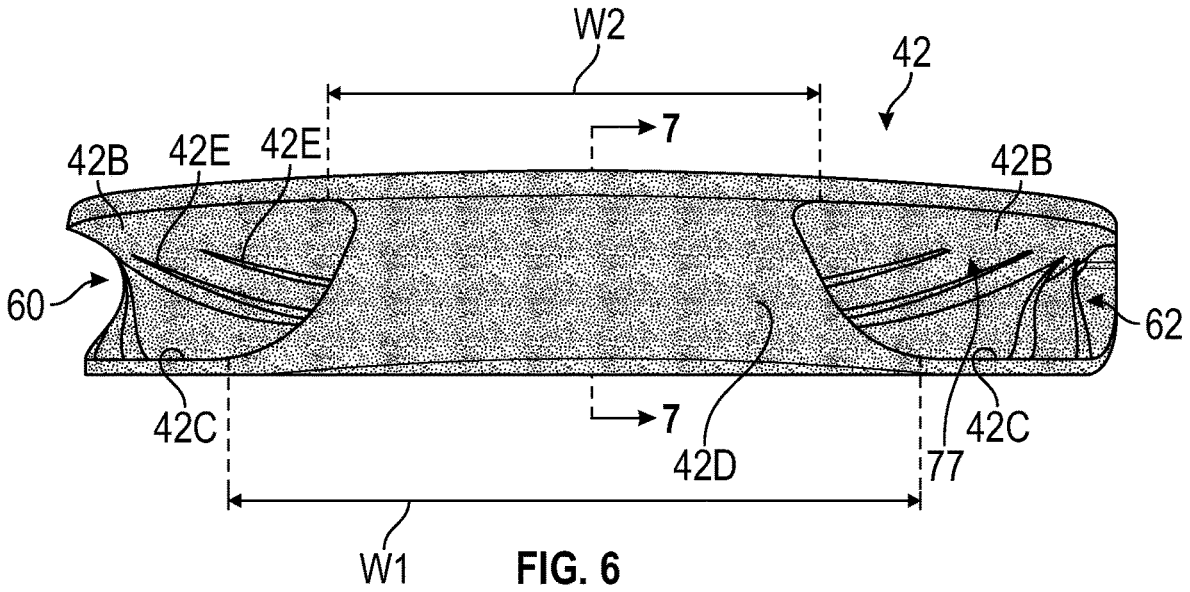
FIG. 6 is a rear view of the heel cushioning unit.
Figure 7:
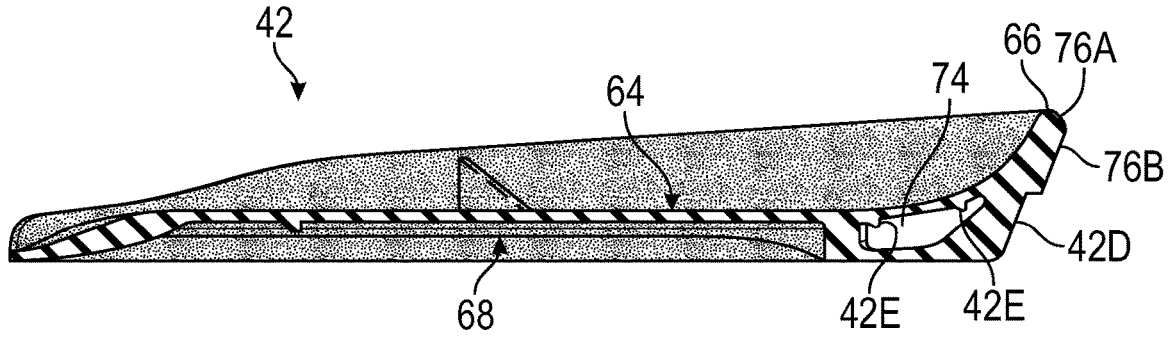
FIG. 7 is a cross-sectional view of the heel cushioning unit taken at lines 7-7 in FIG. 6.
Figure 8:
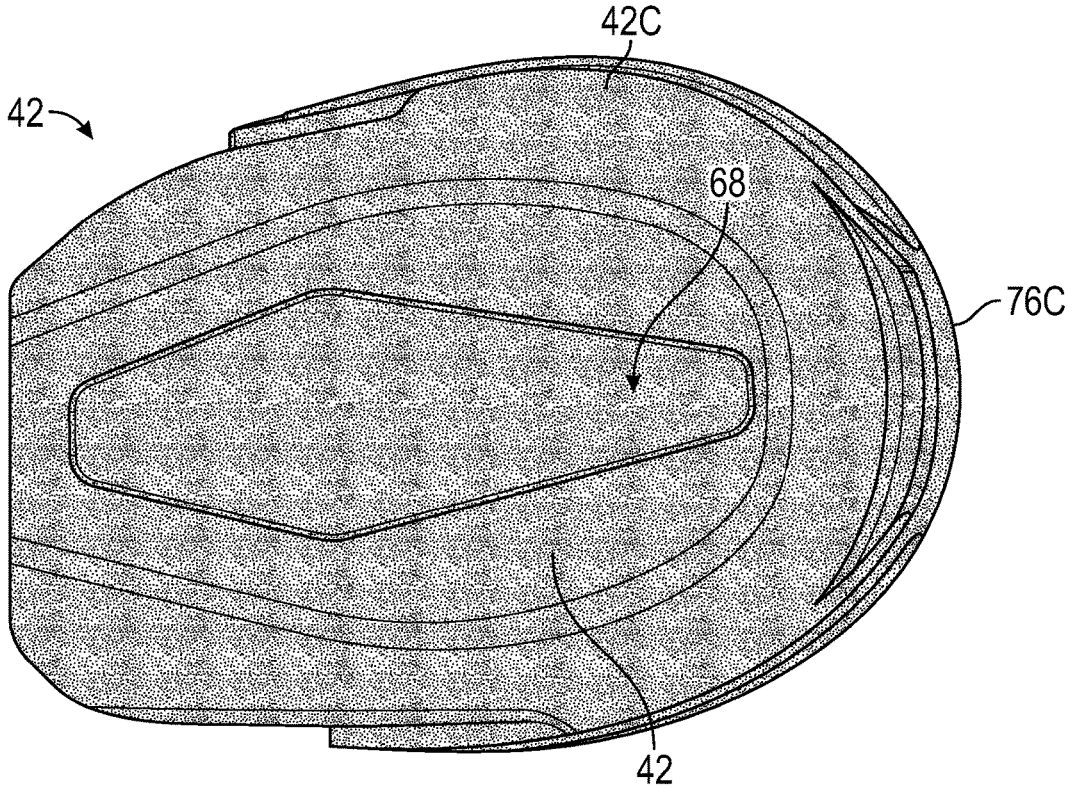
FIG. 8 is a bottom view of the heel cushioning unit.
Figure 9:
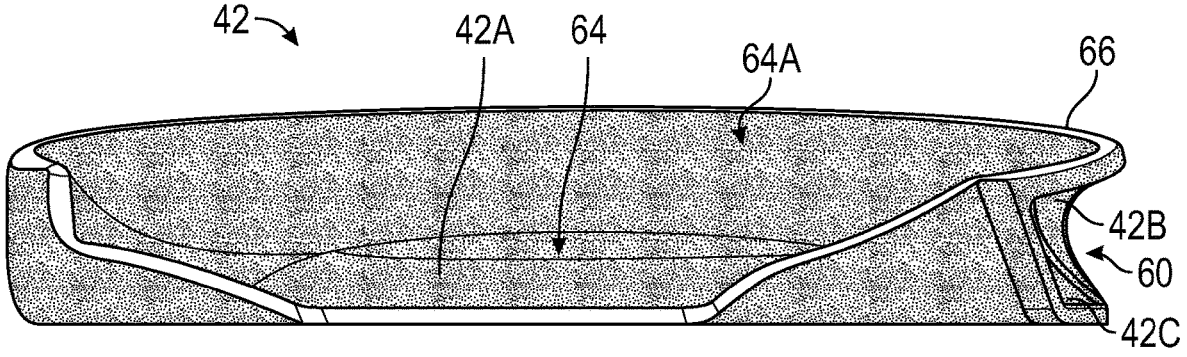
FIG. 9 is a front view of the heel cushioning unit.

FIGS. 4-9 show the heel cushioning unit 42 in isolation. The heel cushioning unit 42 has a body portion 42A, also referred to as a central body portion, that is best shown in FIGS. 7 and 9. Although the heel cushioning unit 42 is shown as a single, unitary component, it need not be a single component but instead can be multiple interconnected components. The heel cushioning unit 42 defines a medial side recess 60 at a medial side 38A of the heel cushioning unit 42, which is at the medial side 38 of the article of footwear 10 when assembled in the sole structure 12. The heel cushioning unit 42 defines a lateral side recess 62 at a lateral side 40A of the heel cushioning unit 42, which is at the lateral side 40 of the article of footwear 10 when assembled in the sole structure 12. Both the medial side recess 60 and the lateral side recess 62 extending transversely inward to the central body portion 42A. The medial side recess 60 and the lateral side recess 62 separate a top portion 42B of the heel cushioning unit 42 from a bottom portion 42C of the heel cushioning unit 42. The top portion 42B is disposed above the medial side recess 60 and the lateral side recess 62, and the bottom portion 42C is disposed below the medial side recess 60 and the lateral side recess 62. Stated differently, the top portion 42B flares upward from the body portion 42A, and the bottom portion 42C flares downward from the body portion 42A.

Referring to FIG. 7, the top surface 64 of the heel cushioning unit 42 is concave to follow the shape of a wearer's foot, and extends to an upper extent 66. The bottom surface 68 of the heel cushioning unit 42 is concave under the central body portion 42A, as best shown in FIGS. 7 and 8. A top surface of the bottom portion 48A of the outsole 48 underlies and confronts a portion of the bottom surface 68 of the heel cushioning unit 42, as is evident in FIGS. 2, 3, 7, and 8, when considered together.

Figure 4:
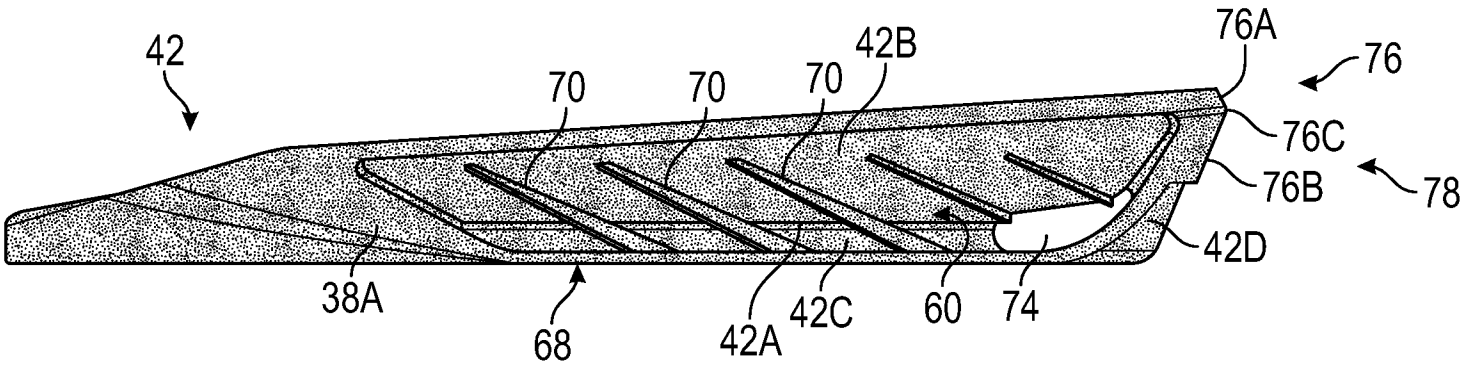
FIG. 4 is a medial side view of a heel cushioning unit included in a sole structure of the article of footwear.

As best shown in FIG. 4, the heel cushioning unit 42 includes medial support fins 70 disposed in the medial side recess 60, extending transversely outward from the body portion 42A, and extending from the top portion 42B to the bottom portion 42C. There are three medial support fins 70, but there could be less than three or more than three. Similarly, as shown in FIG. 5, the heel cushioning unit 42 includes lateral support fins 72 disposed in the lateral side recess 62 and extending transversely outward from the body portion 42A, and also extending from the top portion 42B to the bottom portion 42C. The body portion 42A extends continuously in a transverse direction from the medial support fins 70 to the lateral support fins 72. There are two lateral support fins 72, but there could be fewer or more than two. As shown, the number of medial support fins 70 is greater than the number of lateral support fins 72. The support fins 70 and 72 provide resistance to compression of the top portion 42B toward the bottom portion 42C. By having a greater number of medial support fins 70 than lateral support fins 72, greater support and resistance to compression (e.g., greater compressive stiffness) is provided at the medial side 38A than at the lateral side 40A, assuming that each support fin 70, 72 provides a relatively equal resistance to compression, such as by being of equal thickness in the longitudinal direction (e.g., the fore-aft direction). Accordingly, during activities that tend to load the medial side 38A more than the lateral side 40A, such as during some weightlifting moves, the greater number of medial support fins 70 will provide the medial side 38A with greater resistance to compression to counteract the greater medial side loading, as discussed with respect to FIG. 20. Both the medial support fins 70 and the lateral support fins 72 angle forwardly and upwardly from the bottom portion 42C to the top portion 42B of the heel cushioning unit 42 as shown in FIGS. 4 and 5, respectively. This forward angle reduces the resistance to compression in comparison to a completely vertical fin.

In addition to the medial and lateral side recesses 60, 62, the heel cushioning unit 42 defines a through hole 74 extending from the medial side 38A to the lateral side 40A and disposed rearward of the medial support fins 70 and the lateral support fins 72. The through hole 74 is in communication with and connects the medial and lateral side recesses 60, 62, as best shown in FIGS. 4 and 5. The heel cushioning unit 42 has a rear wall 42D that extends from the bottom portion 42C to the top portion 42B and encloses the through hole 74 rearward of the through hole 74. As best shown in FIG. 6, the rear wall 42D is wider in a transverse direction at the bottom portion 42C than at the top portion 42B. More specifically, the rear wall 42D has a first width W1 at the bottom portion 42C, and tapers to a lesser second width W2 at the top portion 42B. The wider first width W1 provides stability while the taper to a lesser second width W2 enables the top portion 42B of the heel cushioning unit 42 to more readily resiliently deflect toward the bottom portion 42C, such as under dynamic loading.

As also shown in FIGS. 6 and 7, the heel cushioning unit 42 includes ribs 42E that extend along the lower surface 77 of the top portion 42B from the medial side 38A to the lateral side 40A over the through hole 74. Accordingly, the ribs 42E extend into the through hole 74. The ribs 42E may help strengthen the top portion 42B. As best shown in FIG. 7, the top surface 64 is concave, and the bottom surface 68 of the body portion 42A is also concave. The concavity at the bottom surface 68 may be lessened as the heel cushioning unit 42 partially flattens under dynamic loading. The heel cushioning unit 42 returns to the concave shape at the bottom surface 68 once dynamic external stresses are removed. The concavity at the bottom surface 68 thus enables resilient deflection of the body portion 42A under dynamic compressive loading.

Referring again to FIGS. 4-7, the heel cushioning unit 42 includes a beveled upper edge 76 at the upper extent 66 and extending around a rear 78 of the heel cushioning unit 42 from the medial side 38A to the lateral side 40A. The beveled upper edge 76 includes an upper bevel 76A and a lower bevel 76B that meet at an edge 76C. The edge 76C is the rearmost extent of the heel cushioning unit 42 and also the rearmost extent of the article of footwear 10 when the heel cushioning unit 42 is assembled in the sole structure 12. The edge 76C serves as a relatively low friction, low surface area contact region for the article of footwear 10 such as when used for performing inverted wall pushups, as discussed with respect to FIG. 22.

Generally, the heel cushioning unit 42 may be a relatively rigid material or combination of materials. For example, the heel cushioning unit 42 may comprise a thermoplastic elastomer. In other examples, in one or more embodiments, the heel cushioning unit 42 may comprise a carbon fiber, a carbon fiber composite (such as a carbon fiber-filled nylon), a fiberglass-reinforced nylon, which may be an injected, fiber-reinforced nylon, a fiber strand-lain composite, a thermoplastic polyurethane, wood, steel, or another material or combinations of these, but is not limited to these materials. In addition to their geometry, the materials selected for the heel cushioning unit 42 may result in desired performance characteristics. In one example, the heel cushioning unit 42 may be a polyether block amide PEBAX®, available from Arkema, Inc. in King of Prussia, Pennsylvania USA.

The heel cushioning unit 42 may be referred to as a plate. As used herein, the term "plate", refers to a member of a sole structure that has a width greater than its thickness and is generally horizontally disposed when assembled in an article of footwear with the sole structure resting on a level ground surface, so that its thickness is generally in the vertical direction and its width is generally in the horizontal direction. A plate may be a single, unitary component of multiple interconnected components. Portions of a plate can be flat, and portions can have some amount of curvature and variations in thickness when molded or otherwise formed, for example, to provide a shaped footbed and/or increased thickness for reinforcement in desired areas.

Figure 10:
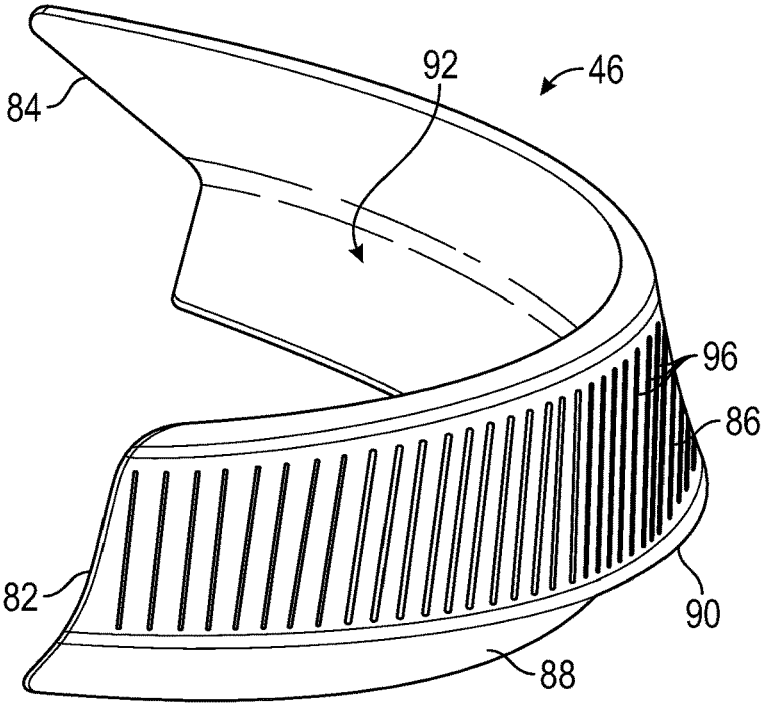
FIG. 10 is a perspective view of a heel guard included in the sole structure.
Figure 11:
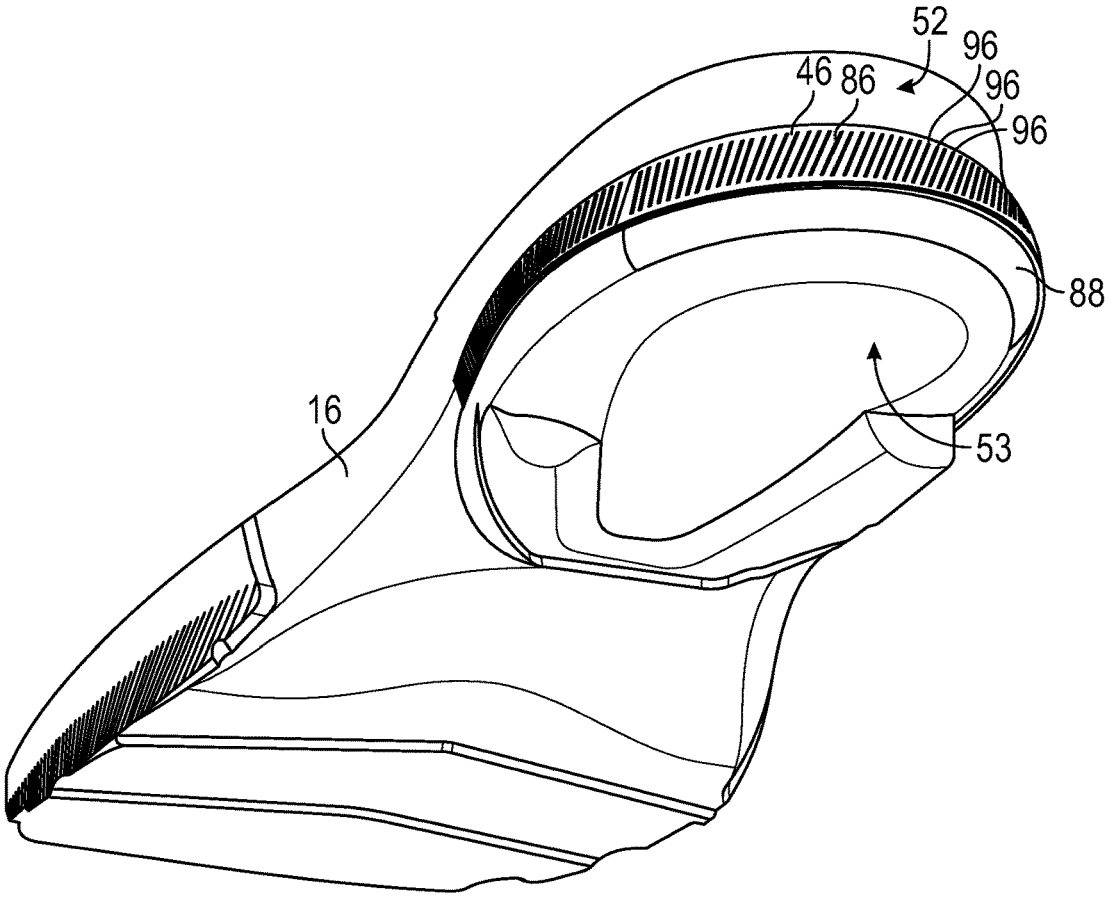
FIG. 11 is a perspective view of the heel guard fit to a midsole layer both of which are included in the sole structure.

FIG. 10 shows the heel guard 46 having a generally arcuate shape extending from a medial edge 82 to a lateral edge 84. The heel guard 46 includes an upper portion 86 and a lower portion 88 recessed at the outer side relative to the upper portion 86 such that the upper portion 86 defines a lip 90. An inner surface 92 of the heel guard 46 is generally concave in both the transverse and vertical directions so that the heel guard 46 fits flush against and is adhered or otherwise secured to the midsole layer 16 as shown in FIG. 11, with the lower portion 88 extending under to the bottom surface 53 of the midsole layer 16, and the upper portion 86 extending upward along the rear surface 52 of the midsole layer 16. The heel guard 46 extends forward along the medial side surface 54 of the midsole layer 16, and forward along the lateral side surface 56 of the midsole layer 16 (see FIG. 3). The lip 90 is the furthest outward extent of the heel guard 46 when the heel guard 46 is secured to the midsole layer 16.

The lower portion 88 of the heel guard 46 is configured to fit flush against and be disposed on the inner surface 64A (see FIG. 9) of the top portion 42B of the heel cushioning unit 42 when the midsole layer 16 is disposed on the top portion 42B of the heel cushioning unit 42 with the bottom surface 53 of the midsole layer 16 secured to the top surface 64 of the heel cushioning unit 42. The lower portion 88 is thus disposed between the midsole layer 16 and the heel cushioning unit 42, and the upper portion 86 extends upward above the beveled upper edge 76 and along the rear surface 52 of the midsole layer 16. The lip 90 rests on the upper extent 66 of top portion 42B above the beveled upper edge 76 as best shown in FIG. 14.

Figure 12:
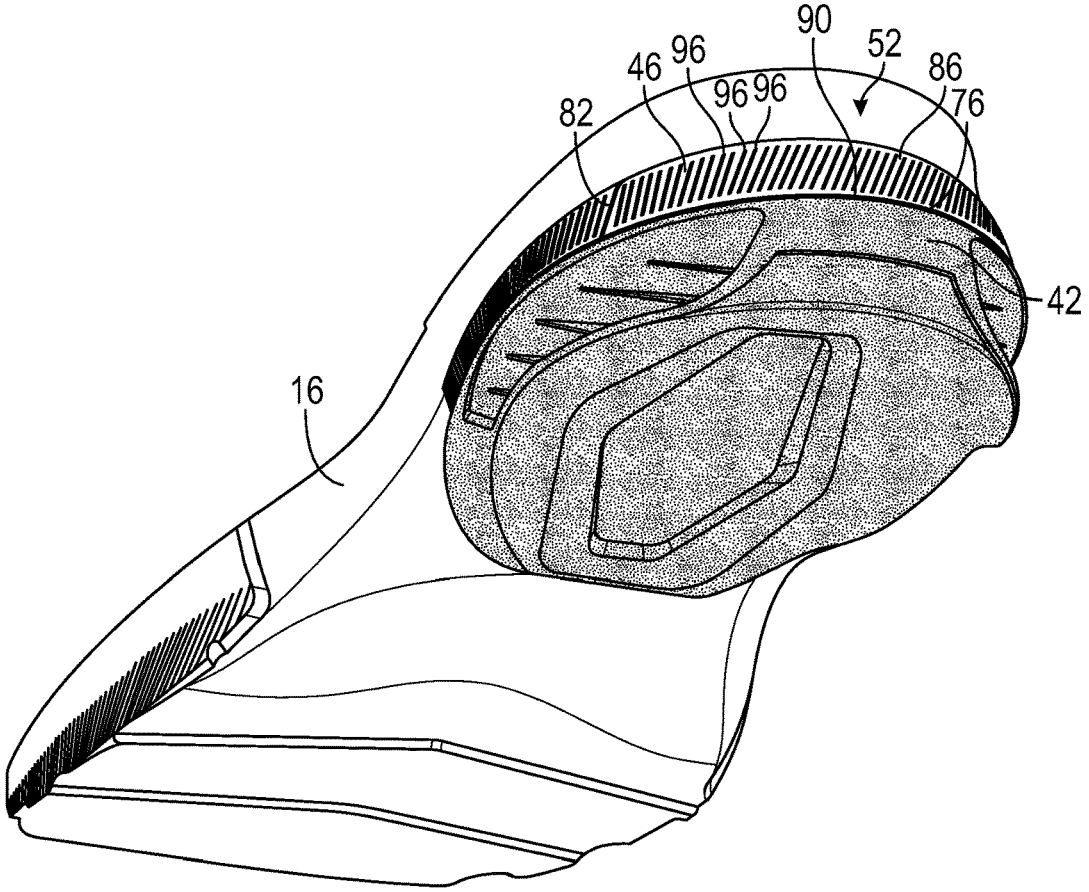
FIG. 12 is a perspective view of the heel guard, the heel cushioning unit, and the midsole layer.
Figure 13:
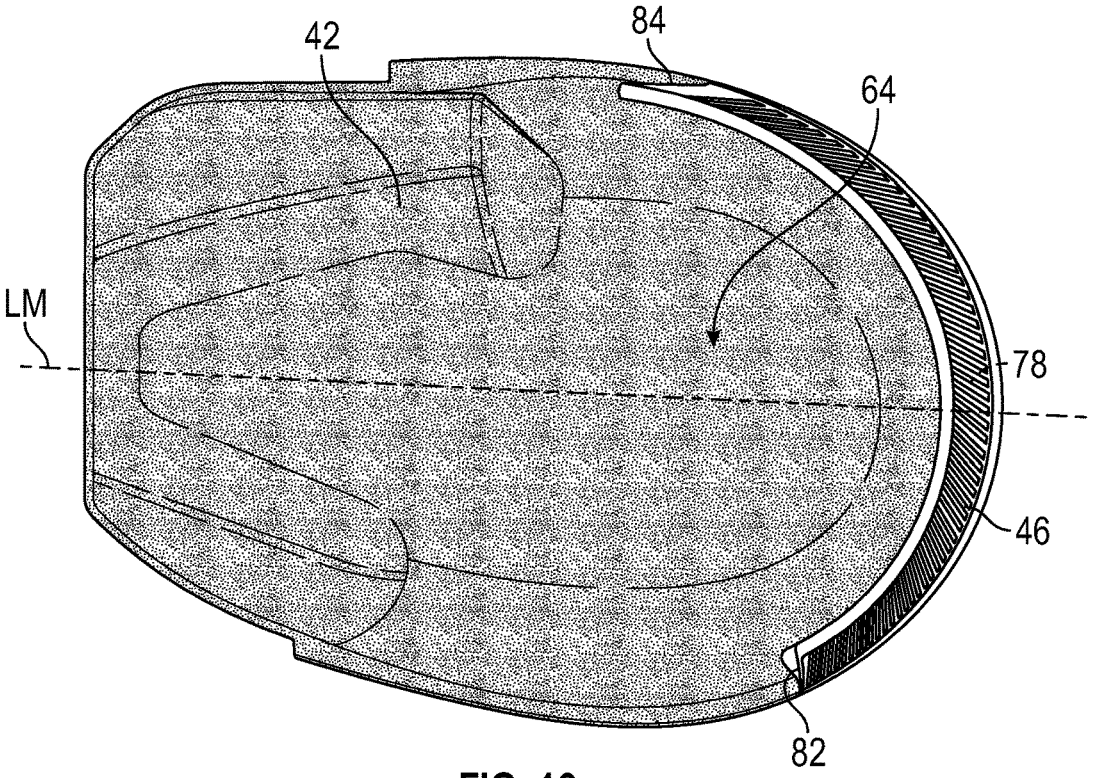
FIG. 13 is a top view of the heel cushioning unit and the heel guard.

As best shown in FIG. 13, the heel guard 46 is asymmetrical about the longitudinal midline LM of the article of footwear 10 because the lateral edge 84 of the heel guard 46 extends further forward than the medial edge 82 of the heel guard 46 when the sole structure 12 is assembled. This configuration may be beneficial during inverted wall pushups (illustrated in FIG. 22), as the feet may tend to splay with the toes pointing outward so that the sole structure 12 contacts a wall 94 more on the lateral side 40 of the sole structure 12 than on the medial side 38. In the embodiment shown, the heel guard 46 is of a harder material with a lower coefficient of friction than the relatively soft midsole layer 16. For example, the heel guard 46 may be any of the materials described herein with respect to the heel cushioning unit 42. The heel guard 46 may reduce any sliding friction against the wall 94 if the feet are tipped so that the heel guard 46 contacts the wall 94 rather than just the beveled upper edge 76 of the heel cushioning unit 42 contacting the wall 94. Additionally, as shown in FIGS. 11 and 12, the outer surface of the upper portion 86 of the heel guard 46 has linear recesses 96 that extend parallel with one another. At least along the rear of the heel guard 46, the linear recesses 96 tilt upward and toward the lateral side of the heel guard 46 from their lowest extent to their highest extent, as best shown in FIG. 11. During inverted wall pushups, the linear recesses 96 may be disposed vertically against the wall 94 due to the splay and tilt of the feet. In such an orientation, the recesses 96 will be in the direction of movement of the article of footwear 10 against the wall 94 (e.g., vertically up and down as shown by double-sided arrows A1 and A2 in FIG. 22). This may reduce contact area and frictional forces of the heel guard 46 against the wall 94.

Figure 14:
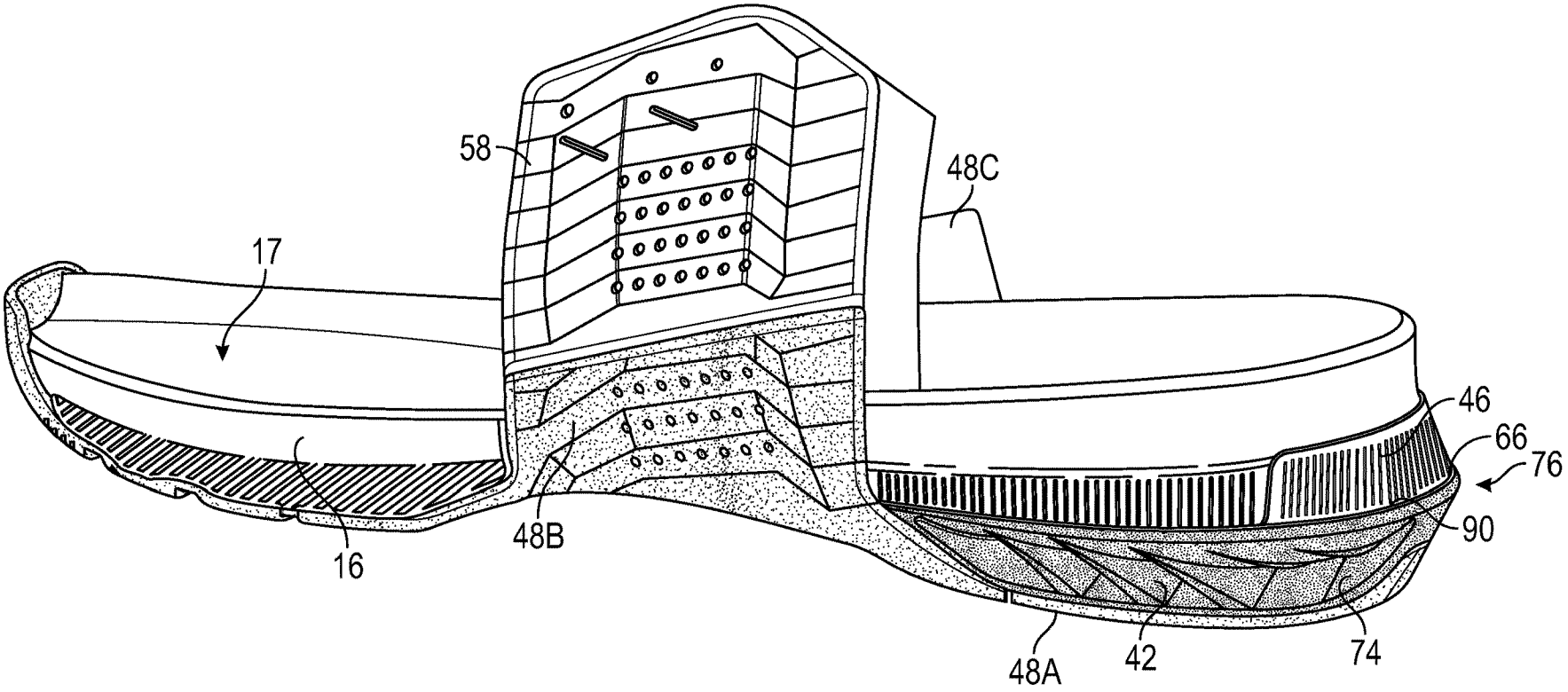
FIG. 14 is a perspective view of the article of footwear with the upper not shown.

FIG. 14 illustrates the side shield 58 extending upward from the medial arch portion 48B. A lower flange 58A of the side shield 58 (shown in FIG. 15) is secured to the inner side of the medial arch portion 48B as best shown in FIG. 19, such as with adhesive and/or by thermal bonding. The side shield 58 may be a different material than the outsole 48 from which it extends. In this manner, the side shield 58 may be optimized for grip in one direction and sliding in an opposite direction during rope climbing, as discussed herein, while the outsole 48 may be optimized for the same functionality, and further optimized for wear resistance and traction. Alternatively, the side shield 58 and the outsole 48 could be a unitary, one-piece component so that the medial arch portion 48B and the side shield 58 are portions of the same component rather than separate components attached at the lower flange 58A. If the side shield 58 and the outsole 48 are a unitary, one-piece component, then no lower flange 58A would be included as the side shield 58 would extend integrally from the medial arch portion 48B without any flange attachment between the two portions being necessary. In either embodiment, the side shield 58 may be of the same material as the outsole 48. The outsole 48 may be formed from materials that may generally include natural or synthetic rubber or other suitably durable materials. The material or materials for the outsole 48 may be selected to provide a desirable combination of durability and flexibility. Synthetic rubbers that may be used include polybutadiene rubber, ethylene propylene rubber (EPR), styrene isoprene styrene (SIS) copolymer rubber, and styrene butadiene rubber.

Figure 15:
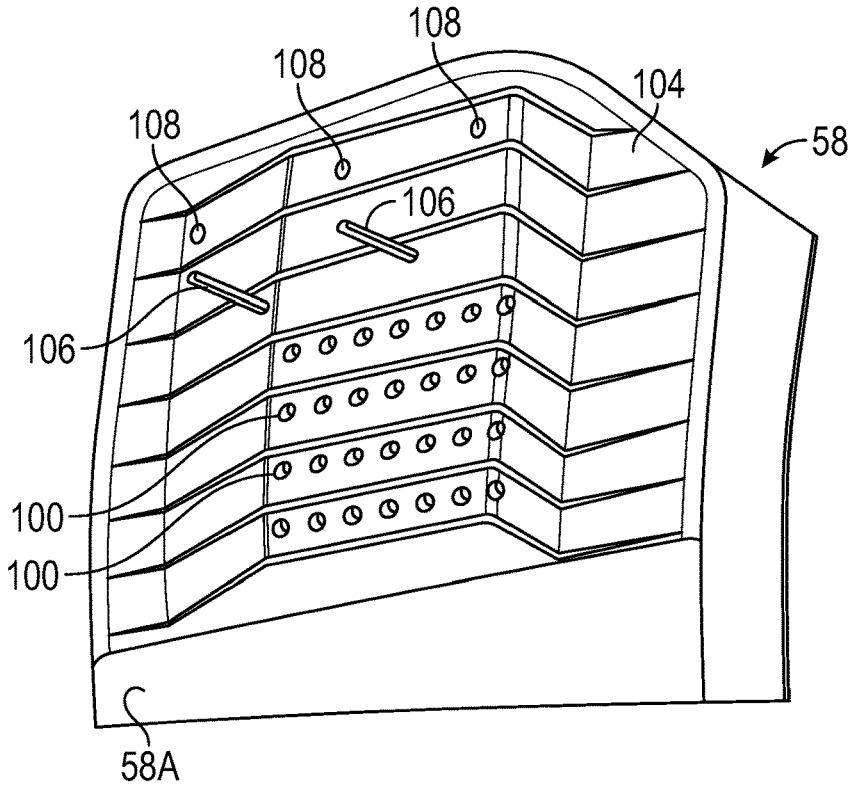
FIG. 15 is a side view of an outer side of a medial side shield of the article of footwear.
Figure 16:
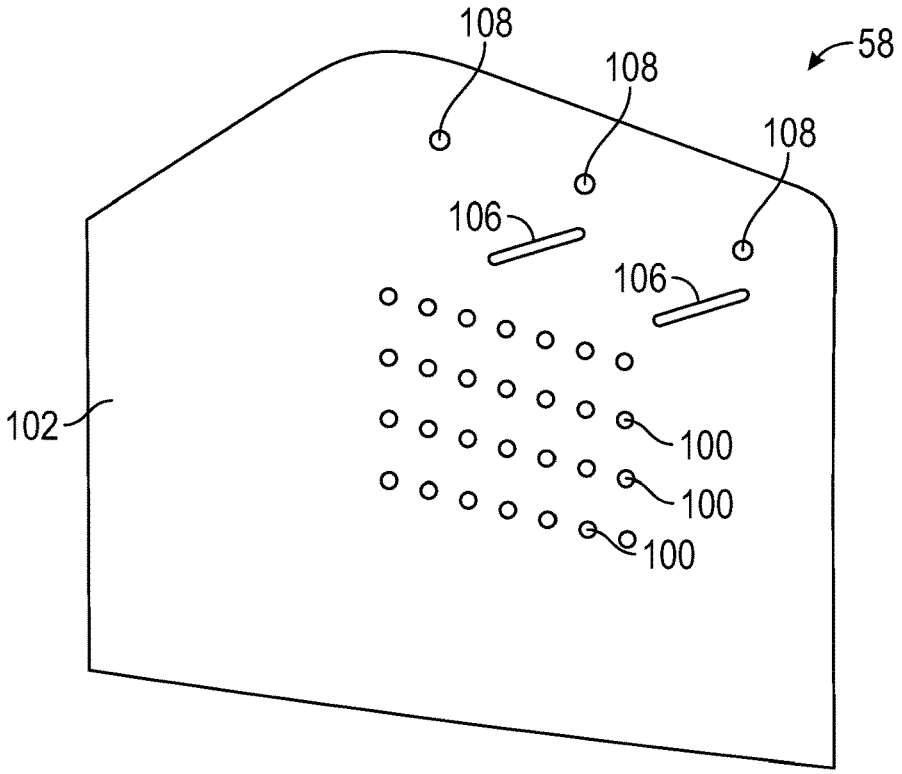
FIG. 16 is a side view of an inner side of the medial side shield of the article of footwear.
Figure 17:
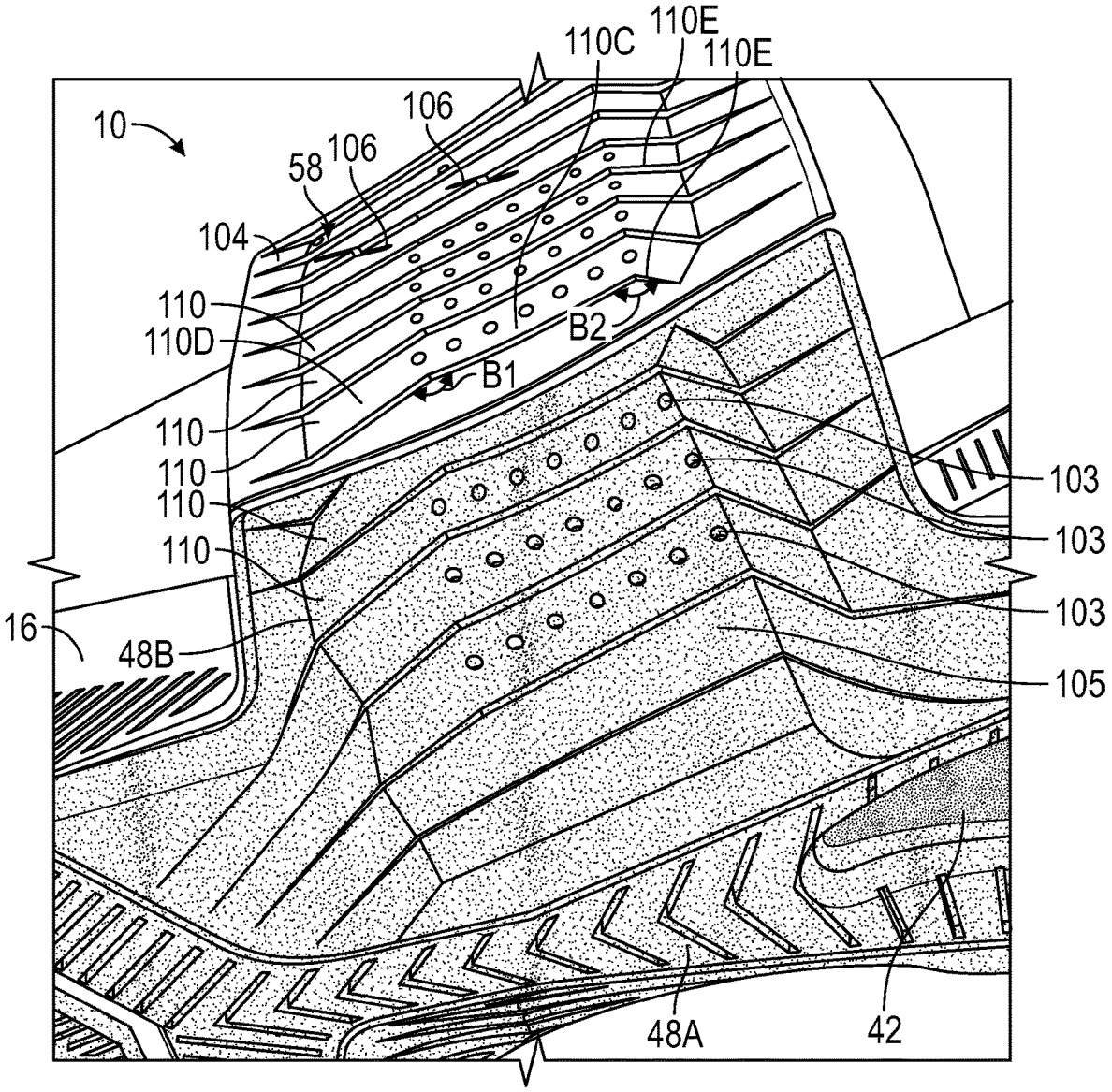
FIG. 17 is a fragmentary side view of the medial side of the article of footwear.

Referring to FIGS. 15 and 16, the side shield 58 defines vent openings 100 that extend through the side shield 58 from an inner side 102 of the side shield 58 to an outer side 104 of the side shield 58. The outer side 104 is also referred to as the exterior of the side shield 58. The vent openings 100 permit venting of the foot-receiving cavity 18 (see FIG. 1), through the upper 14, and out through the vent openings 100. Similarly, the medial arch portion 48B also has vent openings 103 extending through the medial arch portion 48B, as best shown in FIG. 17. Only some of the vent openings 103 are labelled in FIG. 17.

As also shown in FIGS. 15 and 16, the side shield 58 defines two elongated apertures 106 that may be referred to as slits. The elongated apertures 106 extend upwardly from their rearmost extent to their foremost extent at an angle relative to the longitudinal midline LM of the article of footwear 10 (and at an angle relative to a vertical axis) when the side shield 58 is secured on the article of footwear 10, as shown in FIG. 1. The side shield 58 also defines three apertures 108 extending though the side shield 58 from the inner side 102 to the outer side 104. Two of the apertures 108 are above a respective one of the elongated apertures 106 (e.g., above the rearmost aperture 106).

Referring again to FIG. 1, the article of footwear 10 includes tensioning cables 109, some of which extend through the elongated apertures 106 from the inner side 102 to the outer side 104 such that looped portions of the tensioning cables 109 extend outward of the outer side 104. The tensioning cables 109 may be secured to the upper 14 inward of the side shield 58 and may, in some configurations, be secured to the sole structure 12, extending up from the sole structure 12 along or within the upper 14 and then through the elongated apertures 106. The article of footwear 10 may also include a lace 113 or other tensioning member that extends though the looped portions of the tensioning cables 109, and may be tightened to help tension the side shield 58 and the medial arch portion 48B against the upper 14 and the foot therein. Additional looped cables 109 are shown forward of the side shield 58, and the lace 113 also extends through these looped cables, as well as looped cables 109 extending upward along the lateral side 40 of the upper 14 (some of which are visible in FIG. 3).

As best shown in FIG. 17, the exterior of the side shield 58 (e.g. the outer side 104) and the exterior of the medial arch portion 48B (e.g., the outer side 105 of the medial arch portion 48B) includes stepped ridges 110, only some of which are indicated by reference number in FIG. 17. Each stepped ridge 110 extends lengthwise in the fore-aft direction of the article of footwear 10 (e.g., generally in a direction that extends from the forefoot region 32 to the heel region 36, such as in a direction along the longitudinal midline LM). Stated differently, each stepped ridge 110 is longer in the fore-aft direction than in the vertical direction. As best shown in FIG. 19, each stepped ridge 110 is relatively thicker at a lower extent 110A of the stepped ridge 110 than at an upper extent 110B of the stepped ridge such that the stepped ridge 110 angles outward from the upper extent 110B to the lower extent 110A. As shown in FIG. 17, the vent openings 100 extend in rows along the stepped ridges 110, each row extending through one of the stepped ridges 110 between the upper extent 110B and the lower extent 110A. As shown in FIG. 19, the lateral arch portion 48C also has stepped ridges 110. Moreover, at least some of the stepped ridges 110 underlie the midsole layer 16. The tensioning cables 109 and the lace 113 are not shown in FIG. 17 for clarity in the drawings in order to focus on the features of the medial arch portion 48B and the side shield 58.

Figure 20:
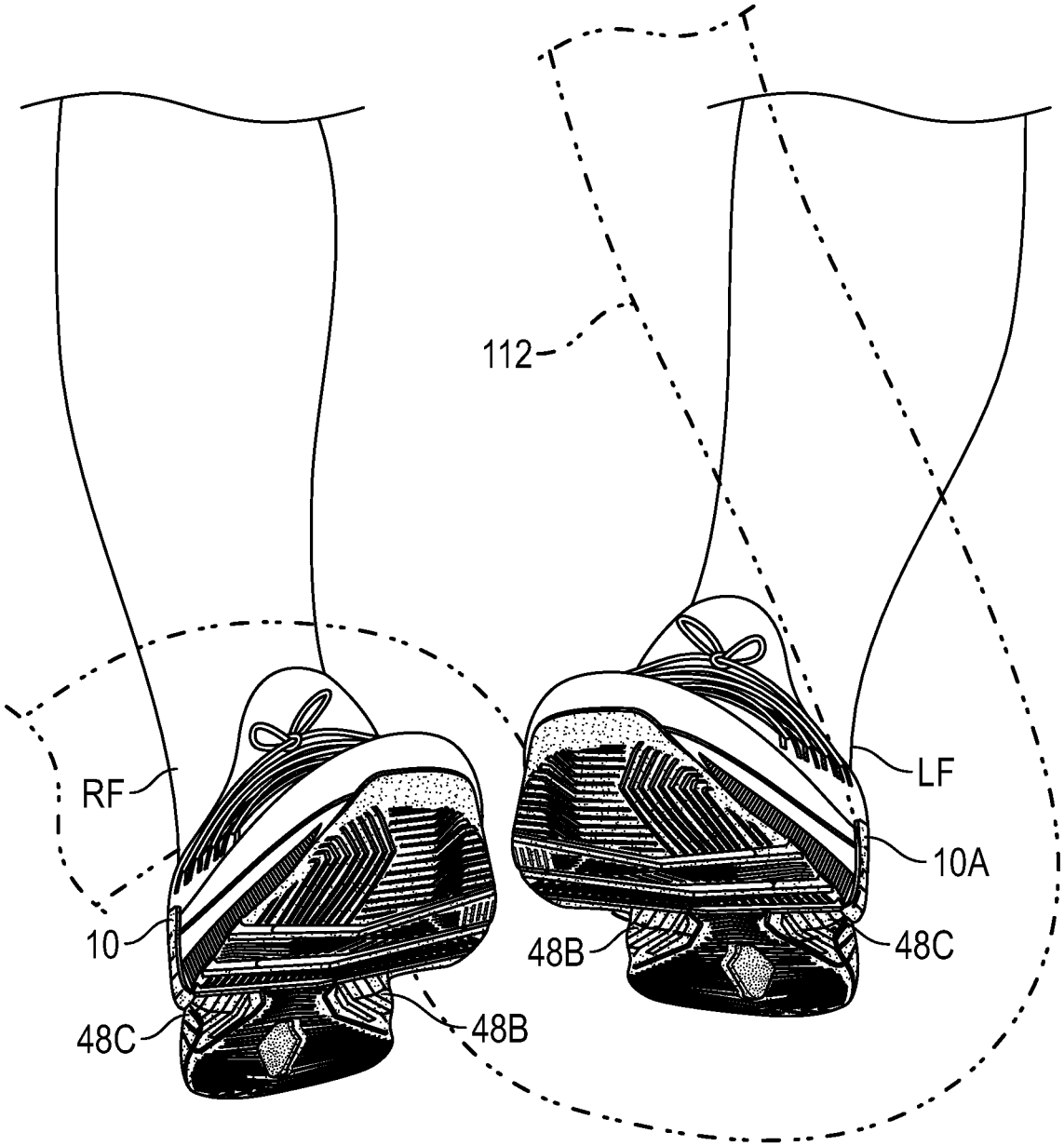
FIG. 20 is a fragmentary illustration of a person wearing a pair of the article of footwear during rope climbing and showing a rope in phantom.

Referring to FIG. 19, the height H of each stepped ridge 110 is greater than the width W of its underside where the width W is measured generally in a transverse direction of the article of footwear 10. With this configuration, and by angling outward from the upper extent 110B to the lower extent 110A, the stepped ridges 110 tend to grip an object contacting the stepped ridges 110 and provide greater friction and resistance to movement of the object in a direction from the lower extent 110A toward the upper extent 110B, as the protruding lower edge 111 of each stepped ridge 110 functions like a hook or barb and tends to dig into and/or created greater friction against the object. In contrast, an object contacting the stepped ridges 110 encounters relatively low resistance to movement in a direction from the upper extent 110B toward the lower extent 110A, as the object can slide over the stepped ridge 110 and past the protruding lower edges 111. Accordingly, with reference to FIG. 20, when the article of footwear 10 is worn during climbing of a rope 112, the article of footwear 10 can move up against the rope 112 with little or no resistance from the stepped ridges 110, and then grip the rope 112 via the stepped ridges 110 once weight is pressed downward against the rope 112, as shown in FIG. 20.

Referring again to FIG. 17, each stepped ridge 110 includes a series of linear segments 110C, 110D, and 110E along its length. The linear segments include a center linear segment 110C, a front linear segment 110D extending forwardly and downwardly from the center linear segment 110C at a first obtuse angle B1, and a rear linear segment 110D extending rearwardly and downwardly from the center linear segment 110C at a second obtuse angle B2. The linear segments 110C, 110D, 110E and angles B1, B2 are labelled with respect to only one of the stepped ridges 110 in FIG. 17 for clarity in the drawings, but apply to and describe each of the stepped ridges 110. By angling the front linear segment 110D relative to the center linear segment 110C, the two segments 110C, 110D can better act as a wedge against an object such as the rope 112 disposed against the center linear segment 110C when movement of the rope 112 relative to the article of footwear 10 is toward the angled intersection of the segments 110C, 110D. Furthermore, if the article of footwear 10 is positioned against the rope 112 with the heel region 36 lower than the forefoot region 32, the front linear segments 110D may extend so that they are perpendicular to the axis of the rope 112 along their lengths. This may improve grip in this orientation of the article of footwear 10. Similarly, by angling the rear linear segment 110E relative to the center linear segment 110C, the two segments 110C, 110E can better act as a wedge against an object such as the rope 112 when the article of footwear 10 is moved relative to the rope 112 so that the rope 112 moves in a direction toward the angled intersection of the segments 110C, 110E. Furthermore, if the article of footwear 10 is positioned against the rope 112 with the heel region 36 higher than the forefoot region 32, the rear linear segments 110E may extend so that they are perpendicular to the axis of the rope 112 along their lengths. This may improve grip in this orientation of the article of footwear 10.

Figure 18:
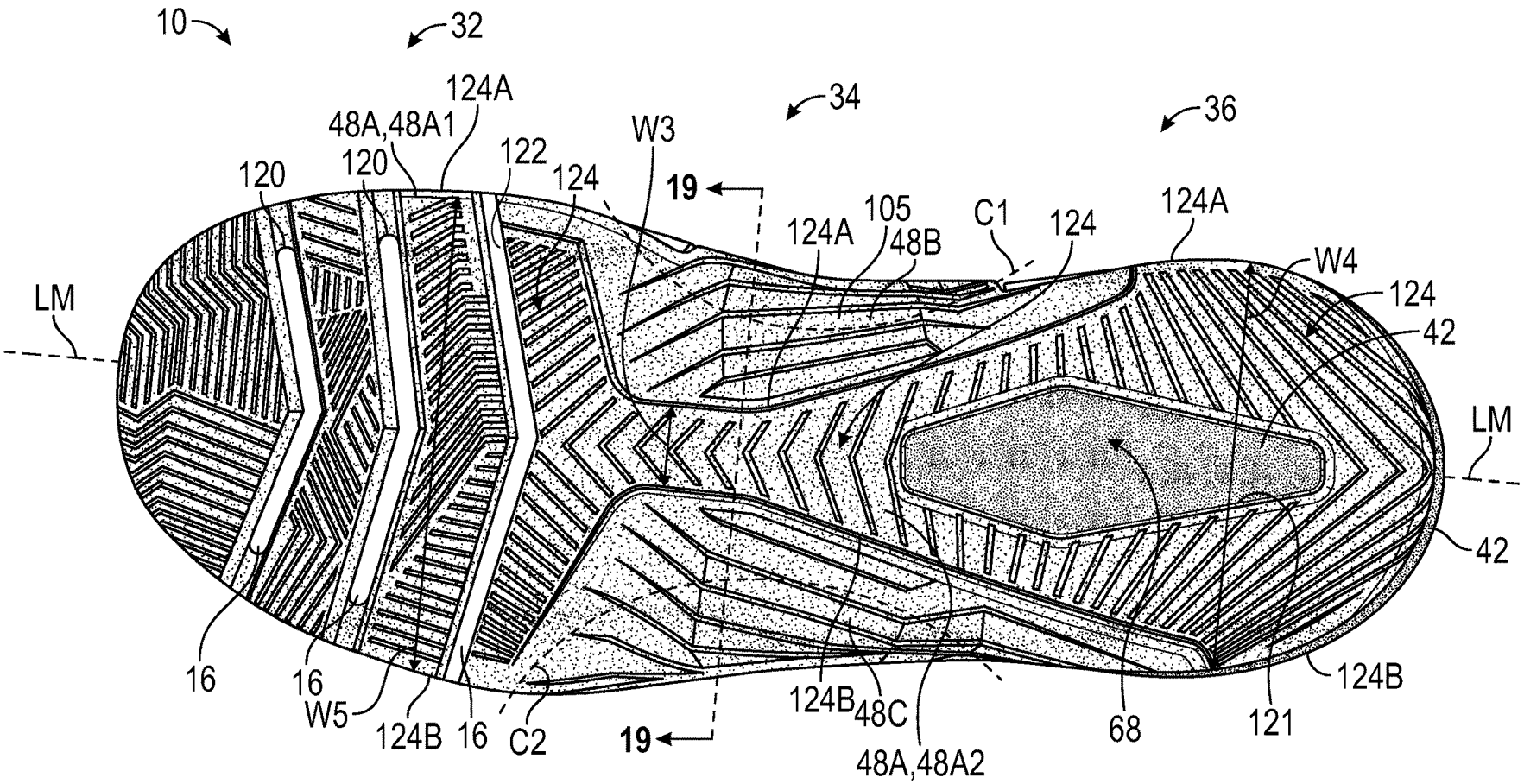
FIG. 18 is a bottom view of the article of footwear.

As best shown in FIG. 18, the outer side 105 of the medial arch portion 48B is concave in the fore-aft direction, as indicated by the example surface curvature C1 representing a curve along the outer side 105 in a plane parallel to a horizontal ground plane when the bottom portion 48A of the outsole 48 is resting on the ground plane. The outer side of the lateral arch portion 48C is also concave in the fore-aft direction, as indicated by the example surface curvature C2. As also indicated in FIG. 18, the bottom portion 48A of the outsole 48 may have two discrete sections, including a front section 48A1 and a rear section 48A2. The front section 48A1 has apertures 120 through which the midsole layer 16 is exposed. A gap 122 between and separating the front section 48A1 and the rear section 48A2 also exposes the midsole layer 16. The arch portions 48B and 48C are integral with the rear section 48A2. Alternatively, the front section 48A1 and the rear section 48A2 may be integrally attached as a one-piece component rather than discrete components. The rear section 48A2 also has an aperture 121 through which the bottom surface 68 of the heel cushioning unit 42 is exposed.

As shown in FIG. 18, a ground contact surface 124 of the outsole 48 (e.g., the surface of the bottom portion 48A) tapers inward from the heel region 36 of the outsole 48 to the midfoot region 34 of the outsole 48, and tapers inward from the forefoot region 32 of the outsole 48 to the midfoot region 34. A transverse width of the ground contact surface 124 at the midfoot region 34 is represented at transverse width W3, but may be taken anywhere in the midfoot region 34. As used herein, a transverse width of the ground contact surface 124 is a width taken perpendicular to the longitudinal midline LM from the medial edge 124A of the ground contact surface 124 to the lateral edge 124B of the ground contact surface 124. The medial edge 124A and the lateral edge 124B also denote the outer edges of the bottom portion 48A. A transverse width of the ground contact surface 124 at the heel region 36 is represented as transverse width W4 in FIG. 18. A transverse width of the ground contact surface 124 at the forefoot region 32 is represented as transverse width W5 in FIG. 18. The transverse width W3 of the ground contact surface 124 at the midfoot region 34 is less than the transverse width W4 of the ground contact surface 124 at the heel region 36, and less than the transverse width W5 of the ground contact surface 124 at the forefoot region 32. It can be seen that the transverse width of the ground contact surface 124 in the midfoot region 34 whether measured precisely at the location where the width is W3 or measured elsewhere in the midfoot region 34 is approximately one-third to one-half the maximum transverse width of the ground contact surface 124 in the heel region 36 and one-third to one-half the maximum transverse width of the ground contact surface 124 in the forefoot region 32.

The medial arch portion 48B extends upward from the medial edge 124A of the ground contact surface 124, and the lateral arch portion 48C extends upward from the lateral edge 124B of the ground contact surface 124. The tapering of the ground contact surface 124 from the forefoot region 32 and the heel region 36 to the narrower transverse width W3 in the midfoot region 34 allows the arch portions 48B, 48C to partially underlie the midsole layer 16 before extending upward along the side surfaces 54, 56 of the midsole layer 16 and the medial and lateral sides 38, 40 of the upper 14. Accordingly, at least some of the stepped ridges 110 underlie the midsole layer 16 in the midfoot region 34 as shown in both FIGS. 18 and 19 (as well as in FIGS. 2 and 3). This provides an even greater surface area of the article of footwear 10 for gripping of the rope 112 as in FIG. 22 and allows gripping when the article of footwear 10 comes into contact with the rope 112 from many different directions and positions.

As shown in FIG. 20, during crossfit rope climbing, the rope 112 may be clamped between the wearer's feet, with one foot (e.g., left foot LF in FIG. 20) supported on and pushing against the rope 112 and the rope 112 extending over the other foot (e.g., over right foot RF in FIG. 20). The article of footwear 10 is shown on the right foot RF and a mirror image article of footwear 10A having identical features as right foot footwear 10 is configured for and shown in the left foot LF. Due to the concavities of the articles of footwear 10, 10A at the medial arch portions 48B, when the articles of footwear 10, 10A are brought together around the rope 112, the rope 112 is trapped in a tunnel defined by and between the two opposing medial arch portions 48B. Because the lateral arch portions 48C also have concavity in the fore-aft direction, other rope climbing techniques may be used in which the rope 112 is trapped between the medial arch portion 48B of one of the right and left footwear 10, 10A and the lateral arch portion 48C of the other one of the right and left footwear 10, 10A with the portions 48B, 48C creating a tunnel wrapping around the rope 112, such as when the legs are crossed so the lateral arch portion 48C of one of the articles of footwear 10 or 10A faces the medial arch portion 48B of the other of the articles of footwear 10 or 10A.

Figure 21:
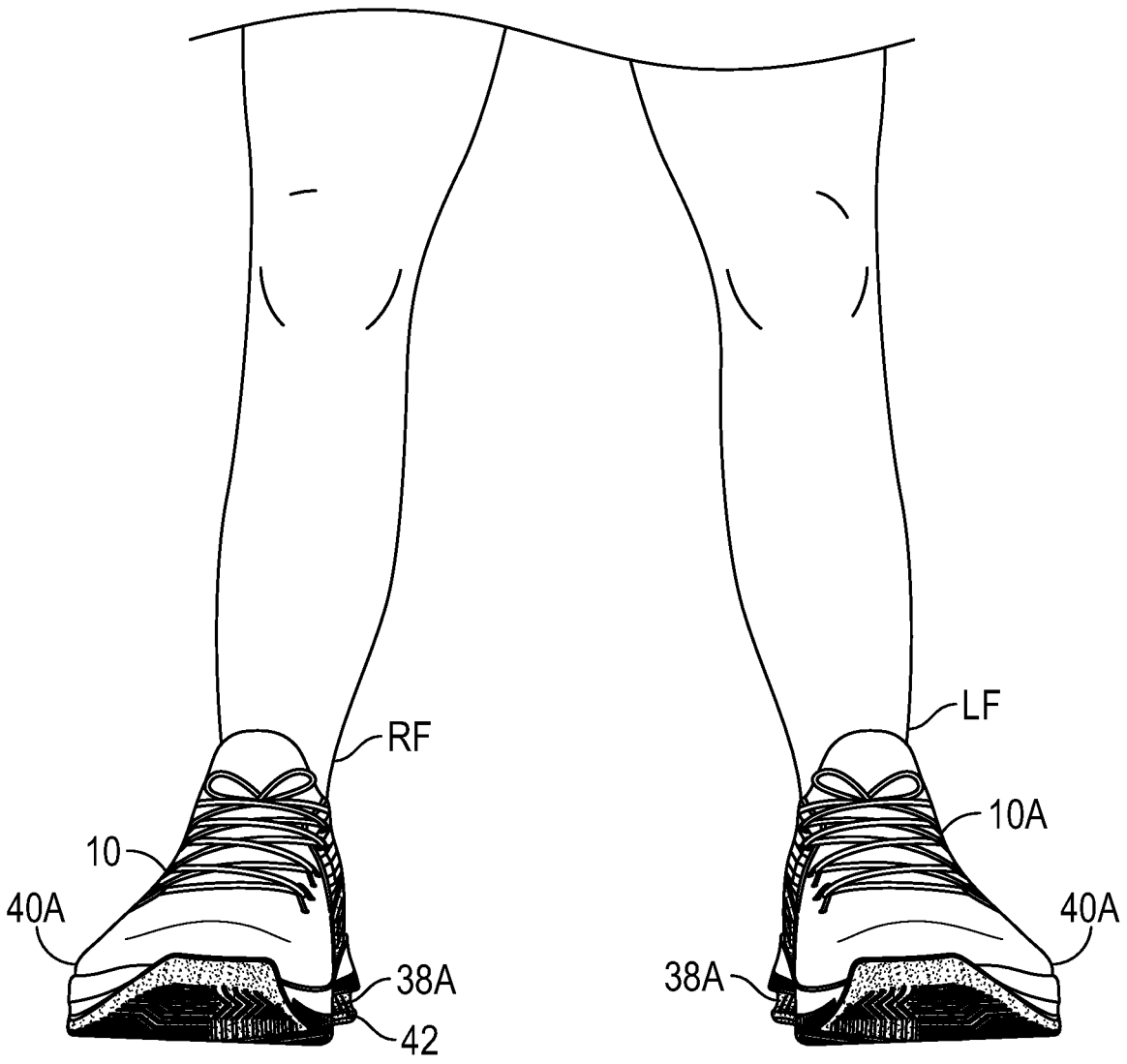
FIG. 21 is a fragmentary illustration of the person wearing the pair of the article of footwear with the person's feet spread in a weightlifting stance.

FIG. 21 shows the feet RF, LF spread apart in a stance that may be taken during weightlifting, for example. In this position, more weight may be borne at the medial side 38A of the articles of footwear 10, 10A than at the lateral side 40. The greater number of support fins 70 on the medial side 38A of the heel cushioning unit 42 (see FIG. 2) provide greater resistance to compressibility at the medial side 38A of the heel cushioning unit 42, helping to tune the response to the uneven load distribution on the articles of footwear 10, 10A.

Figure 22:
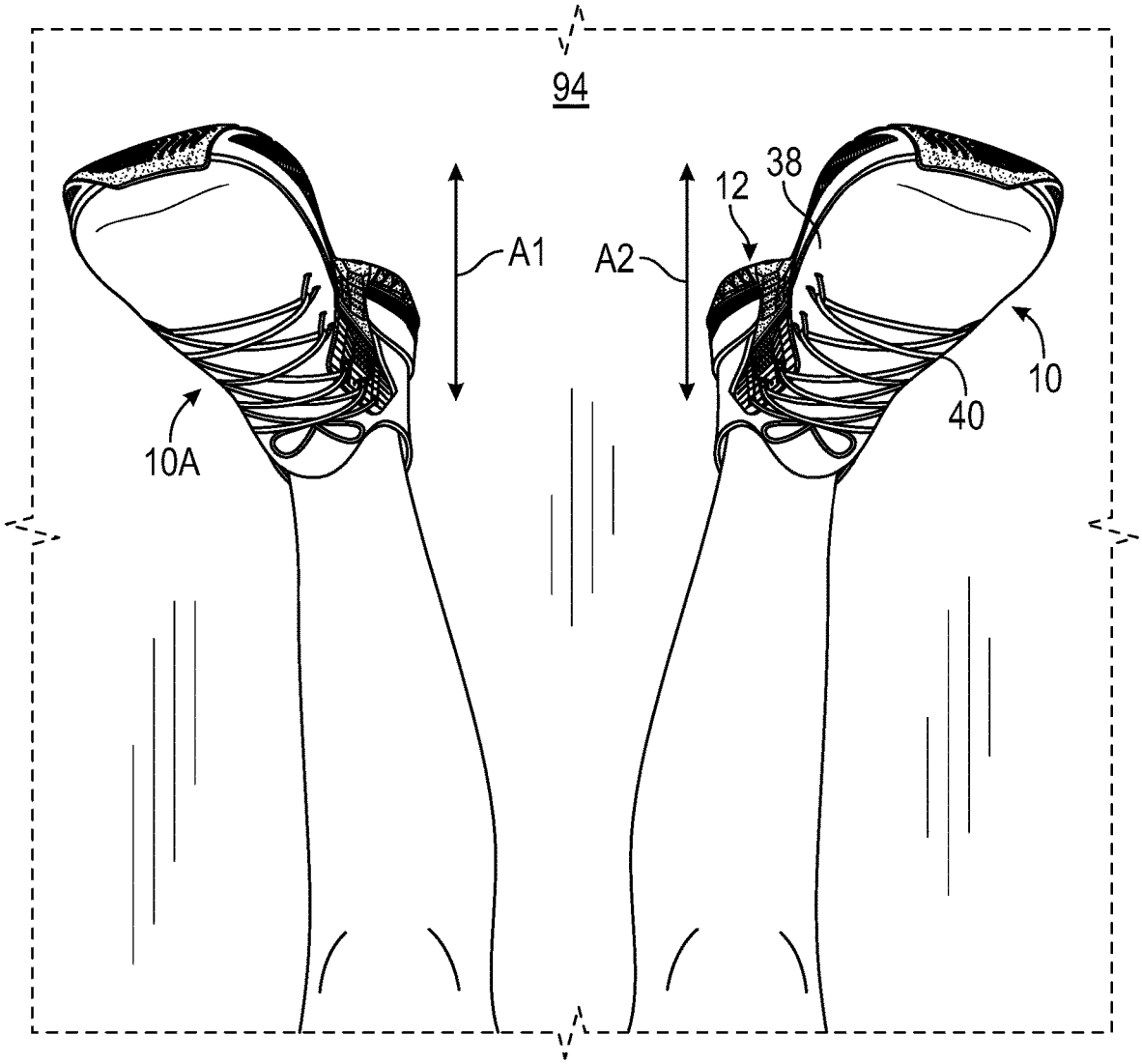
FIG. 22 is a fragmentary illustration of the person wearing the pair of the article of footwear with the pair of footwear against a wall during inverted wall pushups.

FIG. 22 shows the wearer in an inverted position, such as when doing an inverted pushup, with the articles of footwear 10, 10A moving against the wall 94 as discussed herein, so that the beveled upper edge 76 and heel guard 46 reduce friction as discussed with respect to FIGS. 12 and 13, for example.

Accordingly, the article of footwear 10 provides multiple components and features advantageous for efficiently carrying out various athletic activities such as during a crossfit workout or competition, including the heel cushioning unit 42, the heel guard 46, the outsole 48 with arch portions 48B, 48C and stepped ridges 110, and the side shield 58.

The following Clauses provide example configurations of an article of footwear disclosed herein.

Clause 1. An article of footwear comprising: a sole structure including a heel cushioning unit; wherein the heel cushioning unit has a top portion, a bottom portion, a body portion connecting the top portion to the bottom portion, medial support fins in a medial side recess defined by the heel cushioning unit at a medial side of the heel cushioning unit and lateral support fins in a lateral side recess defined by the heel cushioning unit at a lateral side of the heel cushioning unit, both the medial support fins and the lateral support fins extending transversely outward from the body portion and extending from the top portion to the bottom portion; and wherein the heel cushioning unit defines a through hole extending from the medial side to the lateral side and disposed rearward of the medial support fins and the lateral support fins.

Clause 2. The article of footwear of clause 1, wherein the medial support fins are greater in number than the lateral support fins.

Clause 3. The article of footwear of any of clauses 1-2, wherein the medial support fins angle forwardly and upwardly from the bottom portion to the top portion of the heel cushioning unit.

Clause 4. The article of footwear of any of clauses 1-3, wherein the lateral support fins angle forwardly and upwardly from the bottom portion to the top portion of the heel cushioning unit.

Clause 5. The article of footwear of any of clauses 1-4, wherein the heel cushioning unit defines a rear wall enclosing the through hole rearward of the through hole and extending from the top portion and to the bottom portion of the heel cushioning unit.

Clause 6. The article of footwear of clause 5, wherein the rear wall is wider in a transverse direction at the bottom portion than at the top portion.

Clause 7. The article of footwear of any of clauses 1-6, wherein the heel cushioning unit has a beveled upper edge extending around a rear of the heel cushioning unit from the medial side to the lateral side.

Clause 8. The article of footwear of clause 7, wherein the sole structure further includes: a midsole layer disposed on the top portion of the heel cushioning unit; and a heel guard having a lower portion disposed on a top surface of the heel cushioning unit between the midsole layer and the heel cushioning unit, and the heel guard having an upper portion extending upward above the beveled upper edge and along a rear surface of the midsole layer.

Clause 9. The article of footwear of clause 8, wherein the heel guard extends around the rear surface of the midsole layer from the medial side of the heel cushioning unit to the lateral side of the heel cushioning unit, and extends further forward along the midsole layer on the lateral side than on the medial side.

Clause 10. The article of footwear of any of clauses 1-9, further comprising: an upper coupled to the sole structure; wherein the sole structure further comprises an outsole underlying a bottom surface of the heel cushioning unit, the outsole having an arch portion wrapping upward along and secured to a side surface of the upper above a biteline between the sole structure and the upper.

Clause 11. The article of footwear of clause 10, further comprising: a side shield extending upward from the arch portion along the side surface of the upper.

Clause 12. The article of footwear of clause 11, further comprising: a tensioning cable; wherein the side shield defines an aperture; and wherein the tensioning cable extends through the aperture from an inner side of the side shield to an outer side of the side shield.

Clause 13. The article of footwear of any of clauses 11-12, wherein: an exterior of the side shield and/or an exterior of the arch portion includes stepped ridges extending lengthwise in a fore-aft direction of the article of footwear; and each stepped ridge is relatively thicker at a lower extent of the stepped ridge than at an upper extent of the stepped ridge such that the stepped ridge angles outward from the upper extent to the lower extent.

Clause 14. The article of footwear of clause 13, wherein each stepped ridge includes a series of linear segments, the linear segments including a center linear segment, a front linear segment extending forward and downward from the center linear segment at a first obtuse angle, and a rear linear segment extending rearward and downward from the center linear segment at a second obtuse angle.

Clause 15. The article of footwear of any of clauses 13-14, wherein: the sole structure further comprises a midsole layer disposed on a top surface of the heel cushioning unit; a ground contact surface of the outsole tapers inward from a heel region of the outsole to a midfoot region of the outsole, and from a forefoot region of the outsole to the midfoot region of the outsole, such that a transverse width of the ground contact surface at the midfoot region from a medial edge of the ground contact surface to a lateral edge of the ground contact surface is less than at the heel region and less than at the forefoot region; the arch portion extends from the medial edge of the ground contact surface; and at least some of the stepped ridges underlie the midsole layer.

Clause 16. The article of footwear of any of clauses 13-15, wherein an outer side of the arch portion is concave in the fore-aft direction.

Clause 17. The article of footwear of any of clauses 11-16, wherein the side shield defines vent openings extending through the side shield from an inner side of the side shield to an outer side of the side shield.

Clause 18. The article of footwear of any of clauses 10-17, wherein: the sole structure further comprises a midsole layer disposed on a top surface of the heel cushioning unit, and disposed on the outsole forward of the heel cushioning unit; and the upper is secured to the top surface of the midsole layer and the biteline is between the midsole layer and the upper.

Clause 19. The article of footwear of any of clauses 10-18, wherein: the arch portion is a medial arch portion and the side surface of the upper is a medial side surface of the upper; and the outsole further includes a lateral arch portion wrapping upward along and secured to a lateral side surface of the upper above the biteline between the sole structure and the upper.

Clause 20. The article of footwear of any of clauses 1-19, wherein the heel cushioning unit defines a rib extending from the medial side to the lateral side and into the through hole.

Clause 21. An article of footwear comprising: an upper; a sole structure secured to the upper and including an outsole having an arch portion wrapping upward along a side surface of the upper; the arch portion defining stepped ridges extending lengthwise in a fore-aft direction of the sole structure, each stepped ridge angling outward from an upper extent of the stepped ridge to a lower extent of the stepped ridge such that the stepped ridge is relatively thicker at the lower extent than at the upper extent; and wherein each stepped ridge includes a series of linear segments, the linear segments including a center linear segment, a front linear segment extending forward and downward from the center linear segment at an obtuse angle, and a rear linear segment extending rearward and downward from the center linear segment at an obtuse angle.

Clause 22. The article of footwear of clause 21, wherein an outer side of the arch portion is concave in the fore-aft direction.

Clause 23. The article of footwear of any of clauses 21-22, the sole structure further comprising a midsole layer overlying the outsole; wherein a ground contact surface of the outsole tapers inward from a heel region of the outsole to a midfoot region of the outsole, and from a forefoot region of the outsole to the midfoot region of the outsole, such that a transverse width of the ground contact surface at the midfoot region from a medial edge of the ground contact surface to a lateral edge of the ground contact surface is less than at the heel region and less than at the forefoot region; and wherein the arch portion extends upward from the medial edge of the ground contact surface and at least some of the stepped ridges underlie the midsole layer.

Clause 24. The article of footwear of any of clauses 21-23, wherein the arch portion is a medial arch portion and the side surface of the upper is a medial side surface of the upper, and the outsole further includes a lateral arch portion wrapping upward along and secured to a lateral side surface of the upper.

Clause 25. The article of footwear of any of clauses 21-24, further comprising: a side shield extending upward from the arch portion along the side surface of the upper.

Clause 26. The article of footwear of clause 25, wherein the side shield also defines stepped ridges extending lengthwise in the fore-aft direction of the sole structure, each stepped ridge angling outward from an upper extent of the stepped ridge to a lower extent of the stepped ridge such that the stepped ridge is relatively thicker at the lower extent than at the upper extent.

Clause 27. The article of footwear of clause 26, wherein each stepped ridge includes a series of linear segments, the linear segments including a center linear segment, a front linear segment extending forward and downward from the center linear segment at a first obtuse angle, and a rear linear segment extending rearward and downward from the center linear segment at a second obtuse angle.

Clause 28. The article of footwear of any of clauses 25-27, wherein the side shield defines vent openings extending through the side shield from an inner side of the side shield to an outer side of the side shield.

Clause 29. An article of footwear comprising: a sole structure including a heel cushioning unit; wherein the heel cushioning unit includes a central body portion and defines a medial side recess at a medial side of the sole structure and a lateral side recess at a lateral side of the sole structure, both the medial side recess and the lateral side recess extending transversely inward to the central body portion, the medial side recess and the lateral side recess separating the heel cushioning unit into a top portion disposed above the medial side recess and the lateral side recess and a bottom portion disposed below the medial side recess and the lateral side recess; the heel cushioning unit including medial support fins extending from the top portion to the bottom portion in the medial side recess and lateral support fins extending from the top portion to the bottom portion in the lateral side recess, both the medial support fins and the lateral support fins extending transversely outward from the central body portion; and wherein the heel cushioning unit defines a through hole extending from the medial side recess to the lateral side recess and disposed rearward of the medial support fins and the lateral support fins.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending along a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending along a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region, and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

a sole structure including a heel cushioning unit; wherein the heel cushioning unit has a top portion, a bottom portion, a body portion connecting the top portion to the bottom portion, medial support fins in a medial side recess defined by the heel cushioning unit at a medial side of the heel cushioning unit and lateral support fins in a lateral side recess defined by the heel cushioning unit at a lateral side of the heel cushioning unit, both the medial support fins and the lateral support fins extending transversely outward from the body portion and extending from the top portion to the bottom portion;

wherein both the medial side recess and the lateral side recess extend transversely inward to the body portion; and wherein the heel cushioning unit defines a through hole in communication with and connecting the medial side recess and the lateral side recess and disposed rearward of the medial support fins and the lateral support fins.

2. The article of footwear of claim 1, wherein the medial support fins are greater in number than the lateral support fins.

3. The article of footwear of claim 1, wherein the medial support fins angle linearly forwardly and upwardly from the bottom portion to the top portion of the heel cushioning unit.

4. The article of footwear of claim 1, wherein the lateral support fins angle forwardly and upwardly from the bottom portion to the top portion of the heel cushioning unit.

5. The article of footwear of claim 1, wherein the heel cushioning unit defines a rear wall enclosing the through hole rearward of the through hole and extending from the top portion and to the bottom portion of the heel cushioning unit.

6. The article of footwear of claim 5, wherein the rear wall is wider in a transverse direction at the bottom portion than at the top portion.

7. The article of footwear of claim 1, wherein the heel cushioning unit has a beveled upper edge extending around a rear of the heel cushioning unit from the medial side to the lateral side.

8. The article of footwear of claim 7, wherein the sole structure further includes:

a midsole layer disposed on a top surface of the heel cushioning unit; and a heel guard having a lower portion disposed on the top surface of the heel cushioning unit between the midsole layer and the heel cushioning unit, and the heel guard having an upper portion extending upward above the beveled upper edge and along a rear surface of the midsole layer.

9. The article of footwear of claim 8, wherein the heel guard extends around the rear surface of the midsole layer from the medial side of the heel cushioning unit to the lateral side of the heel cushioning unit, and extends further forward along the midsole layer on the lateral side than on the medial side.

10. The article of footwear of claim 1, further comprising:

an upper coupled to the sole structure; wherein the sole structure further comprises an outsole underlying a bottom surface of the heel cushioning unit, the outsole having an arch portion wrapping upward along and secured to a side surface of the upper above a biteline between the sole structure and the upper.

11. The article of footwear of claim 10, wherein:

the sole structure further comprises a midsole layer disposed on a top surface of the heel cushioning unit, and disposed on the outsole forward of the heel cushioning unit; and the upper is secured to the top surface of the midsole layer and the biteline is between the midsole layer and the upper.

12. The article of footwear of claim 10, wherein:

the arch portion is a medial arch portion and the side surface of the upper is a medial side surface of the upper; and the outsole further includes a lateral arch portion wrapping upward along and secured to a lateral side surface of the upper above the biteline between the sole structure and the upper.

13. The article of footwear of claim 1, wherein the heel cushioning unit defines a rib extending from the medial side to the lateral side and into the through hole.

14. The article of footwear of claim 1, wherein the sole structure further includes:

a midsole layer disposed on a top surface of the heel cushioning unit; and a heel guard extending along a rear surface of the midsole layer;

wherein a rear of the heel guard defines linear recesses spaced apart from one another and each tilted toward the lateral side of the heel guard from a lowest extent to a highest extent.

15. An article of footwear comprising:

a sole structure including a heel cushioning unit; wherein the heel cushioning unit has a top portion, a bottom portion, a body portion connecting the top portion to the bottom portion, medial support fins in a medial side recess defined by the heel cushioning unit at a medial side of the heel cushioning unit and lateral support fins in a lateral side recess defined by the heel cushioning unit at a lateral side of the heel cushioning unit, both the medial support fins and the lateral support fins extending transversely outward from the body portion and extending from the top portion to the bottom portion;

wherein the heel cushioning unit defines a through hole extending from the medial side to the lateral side and disposed rearward of the medial support fins and the lateral support fins;

an upper coupled to the sole structure; wherein the sole structure further comprises an outsole underlying a bottom surface of the heel cushioning unit, the outsole having an arch portion wrapping upward along and secured to a side surface of the upper above a biteline between the sole structure and the upper;

a side shield extending upward from the arch portion along the side surface of the upper;

wherein an exterior of the side shield and/or an exterior of the arch portion includes stepped ridges extending lengthwise in a fore-aft direction of the article of footwear;

wherein each stepped ridge is relatively thicker at a lower extent of the stepped ridge than at an upper extent of the stepped ridge such that the stepped ridge angles outward from the upper extent to the lower extent; and wherein each stepped ridge includes a series of linear segments, the linear segments including a center linear segment, a front linear segment extending forward and downward from the center linear segment at a first obtuse angle, and a rear linear segment extending rearward and downward from the center linear segment at a second obtuse angle.

16. The article of footwear of claim 15, further comprising:

a tensioning cable;

wherein the side shield defines an aperture; and wherein the tensioning cable extends through the aperture from an inner side of the side shield to an outer side of the side shield.

17. The article of footwear of claim 15, wherein:

the sole structure further comprises a midsole layer disposed on a top surface of the heel cushioning unit;

a ground contact surface of the outsole tapers inward from a heel region of the outsole to a midfoot region of the outsole, and from a forefoot region of the outsole to the midfoot region of the outsole, such that a transverse width of the ground contact surface at the midfoot region from a medial edge of the ground contact surface to a lateral edge of the ground contact surface is less than at the heel region and less than at the forefoot region;

the arch portion extends from the medial edge of the ground contact surface; and at least some of the stepped ridges underlie the midsole layer.

18. The article of footwear of claim 15, wherein an outer side of the arch portion is concave in the fore-aft direction.

19. The article of footwear of claim 15, wherein the side shield defines vent openings extending through the side shield from an inner side of the side shield to an outer side of the side shield.

* * * * *